US006711266B1

(12) United States Patent
Aylward

(10) Patent No.: US 6,711,266 B1
(45) Date of Patent: Mar. 23, 2004

(54) SURROUND SOUND CHANNEL ENCODING AND DECODING

(75) Inventor: J. Richard Aylward, Ashland, MA (US)

(73) Assignee: Bose Corporation, Farmingham, MA (US)

( * ) Notice: Subject to any disclaimer, the term of this patent is extended or adjusted under 35 U.S.C. 154(b) by 842 days.

(21) Appl. No.: 08/796,285

(22) Filed: Feb. 7, 1997

(51) Int. Cl.[7] ..... H04R 5/00

(52) U.S. Cl. ..... 381/22; 381/17; 381/18; 381/23; 381/307

(58) Field of Search ..... 381/17–23, 24–25, 381/26–27, 1, 300, 307

(56) References Cited

U.S. PATENT DOCUMENTS

| | | | | |
|---|---|---|---|---|
| 4,503,553 A | | 3/1985 | Davis | 381/24 |
| 4,799,260 A | * | 1/1989 | Mandell et al. | 381/22 |
| 4,941,177 A | | 7/1990 | Mandell et al. | 381/22 |
| 5,210,802 A | | 5/1993 | Aylward | 381/61 |
| 5,506,907 A | * | 4/1996 | Ueno et al. | 381/17 |
| 5,642,423 A | * | 6/1997 | Embree | 381/22 |

FOREIGN PATENT DOCUMENTS

| | | | |
|---|---|---|---|
| EP | 693829 A | 1/1996 | H03M/7/30 |
| WO | WO 9119407 A | 12/1991 | H04R/5/00 |
| WO | WO 9318630 A | 9/1993 | H04S/3/02 |

OTHER PUBLICATIONS

B.B. Bauer amd G.W. Sioles, Stereophonic Projection Console, Jan./Feb., 1960 IRE Transctions on Audio, vol. AU–8, No. 1, pp. 13–16.

* cited by examiner

*Primary Examiner*—Duc Nguyen
(74) *Attorney, Agent, or Firm*—Fish & Richardson P.C.

(57) ABSTRACT

Surround sound encoding and decoding includes apparatus and techniques for encoding a number of major channels of a surround sound signal, such as left, right, center, left surround and right surround, into a lesser number of channels, such as left transmitted and right transmitted, and decoding the lesser number of channels into a larger number of decoded channels, such as left, right, center, left surround and right surround, for being electroacoustically transduced.

28 Claims, 19 Drawing Sheets

| Decoder # | Lt in | Rt in | L out | R out | C out | S out |
|---|---|---|---|---|---|---|
| 1 | Lt | Rt | L | R | C | S |
| 2 | L | S | L | Ls | $LS_S$ | |
| 3 | R | S | R | Rs | $RS_S$ | |
| 4 | Ls | Rs | Ls | Rs | Cs | |

SURROUND SOUND CHANNEL ENCODING AND DECODING

The present invention relates in general to surround sound encoding and decoding and more particularly concerns novel apparatus and techniques for encoding five major channels of a surround sound signal into two channels and decoding the encoded two channels to effectively retrieve the five major channels.

A typical surround sound signal includes at least left front, center front, right front, left rear and right rear signals. A typical prior art approach combines these signals into two signals that are typically decoded to recover a left front signal, a right front signal, a center front signal and a monophonic rear signal representative of the sum of the original left rear and right rear signals.

It is an important object of the invention to provide improved apparatus and techniques for encoding and decoding surround signals.

A feature of the invention resides in an adaptive matrix decode algorithm signal processor which allows for significantly improved steady-state adjacent channel separation, including a processor for generating true-stereo surround-sound signals with limited channel separation, and an additional center surround signal. This center surround signal can be decoded either from conventional matrix-encoded stereo signals or alternately furnished as an additional signal from discrete channel media.

Another feature resides in electroacoustically manipulating the front stage signals wherein the discretely panned left or right signal information can be "squeezed" inboard of the left and right channel loudspeakers. This feature facilitates reducing the perceived width of the front left/right sound stage image when listening to audio-for-video sound fields reproduced in concert with a video display device, thereby allowing conventional placement of the left/right channel loudspeakers spaced from the display device as in conventional stereophonic sound field reproduction without unnecessarily comprising the audio-for-video sound field reproduction.

Still another feature resides in means for encoding the original 5.1 channel source media into a conventional stereophonic signal, wherein the discrete left and right surround signals are monaurally encoded into a more conventional left total/right total signal format, herein referred to as LT, RT, but with much of the original directional concept preserved.

Other features, objects and advantages of the invention will become apparent from the following detailed description when read in connection with the accompanying drawings in which.

Figure 1:
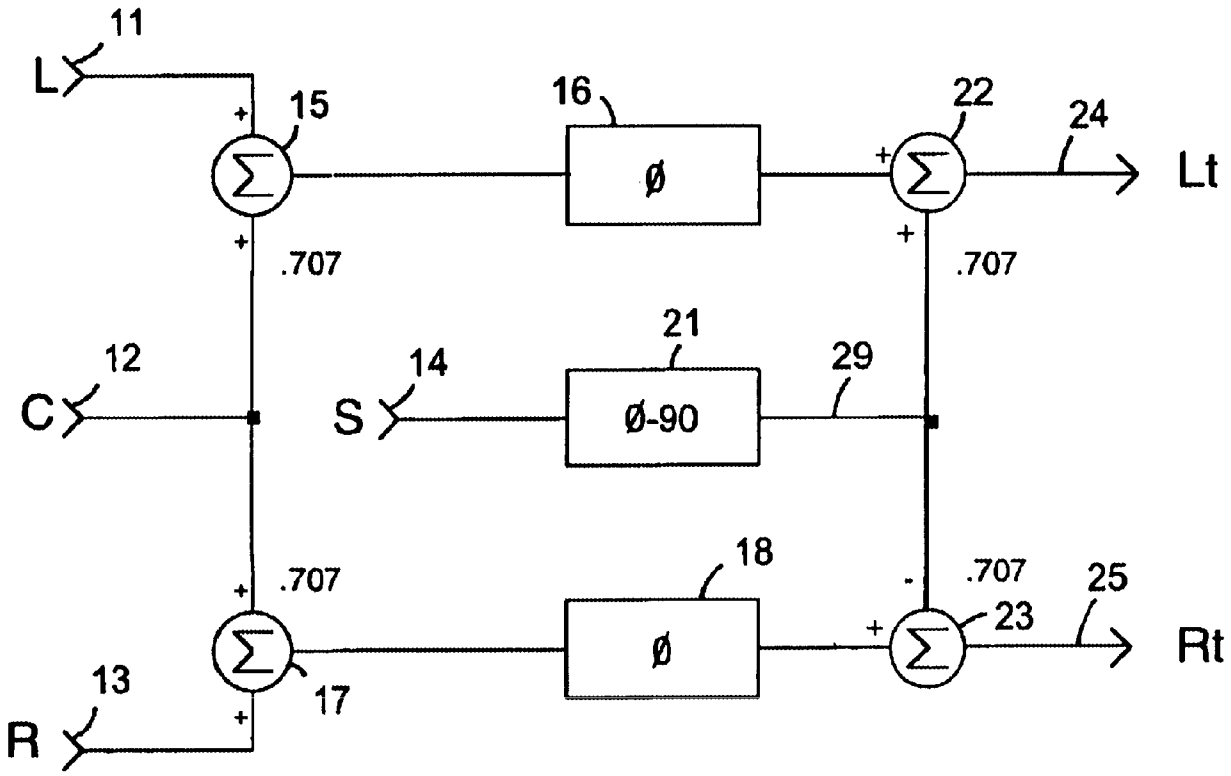
FIG. 1 is a block diagram illustrating the logical arrangement of a generalized standard matrix encoder.

With reference now to the drawings and more particularly FIG. 1, there is shown the logical arrangement of a generalized standard matrix encoder left, center, right and surround input terminals 11, 12, 13 and 14 receive left, center, right and surround signals, respectively. Left-center adder 15 combines the signals on left and center input terminals 11 and 12 to provide a left-center signal to left center phase shift network 16. Right-center summer 17 combines the signals on center and right terminals 12 and 13 to provide a right-center signal to right-center phase shift network 18. Quadrature phase shifter 21 receives the surround signal on terminal 14 to provide a quadrature phase-shifted surround signal that is combined with the left-center phase-shifted signal provided by left-center phase shifter 16 to left output adder 22 to provide the left transmitted signal LT and with the right-center phase-shifted signal provided by right-center phase shifter 18 to right output adder 23 to provide the right-transmitted signal RT.

The surround channel and center channel signals are defined as equal amplitude out-of-phase and in-phase signals, respectively. Encoding a left and center channel signal simultaneously produces only the center channel output at the output of right output adder 23, and the left channel signal plus the center channel signal at the output of left adder 22. Thus, the left and center channel signals cannot be accurately retrieved without first normalizing the relative time-average magnitudes of the left and right transmitted signals LT and RT such that LT is equal to RT at the input terminals of the input amplitude normalization circuitry shown in FIG. 2.

Figure 2:
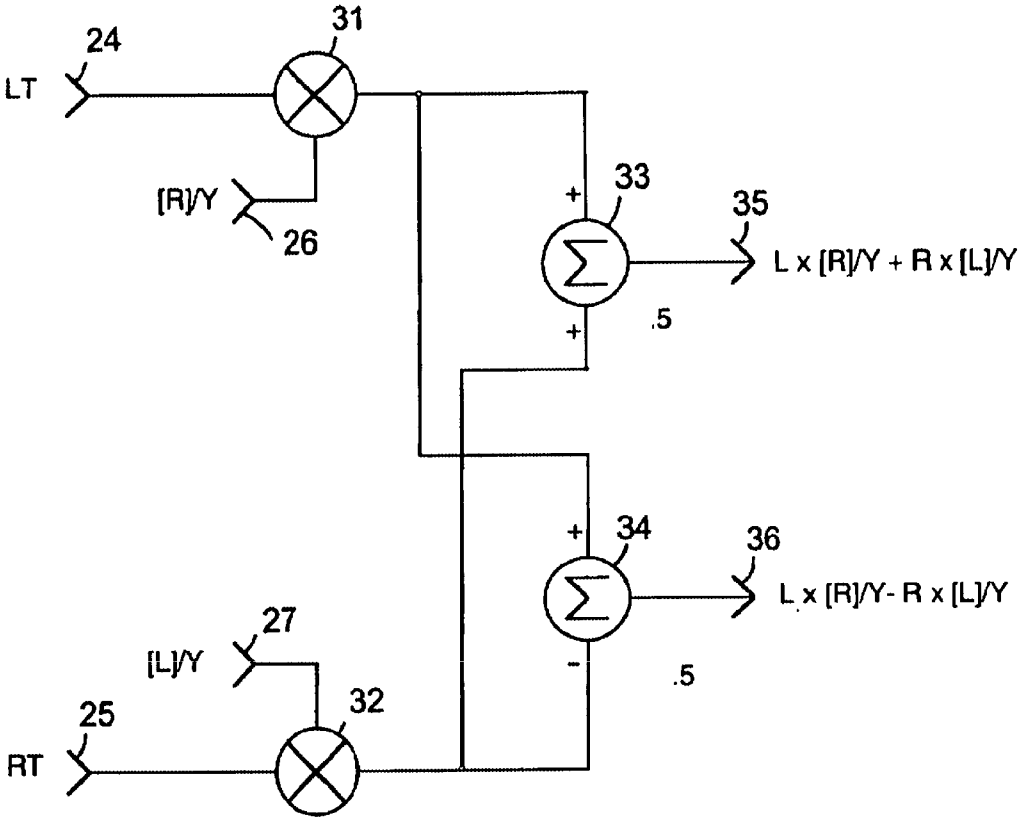
FIG. 2 is a block diagram illustrating the logical arrangement of a system for input amplitude normalization.

Referring to FIG. 2, the left and right transmitted signals LT and RT from left and right output adders 22 and 23, respectively, on terminals 24 and 25, respectively, are multiplied by right and left magnitude signals [R]/Y and [L]/Y, respectively, on input terminals 26 and 27, respectively, of sum and difference multiplier 31 and 32, respectively. The outputs of left and right multipliers 31 and 32 are cumulatively combined in adder 33 and differentially combined in subtractor 34 to provide on terminals 35 and 36 sum and difference levels, respectively.

One method of normalizing the relative magnitudes of LT and RT at the decoder input terminals involves deriving the time-averaged magnitude of LT, RT, and the time-averaged magnitude of whichever of the two is greater when [LT]≠[RT]. (herein referred to as Y). When the two magnitudes are equal, Y is either the time-averaged magnitude of [LT] or [RT]. Expressing these magnitudes in terms of Y produces two usable coefficients:

$$A1=[LT]/Y$$

and $$A2=[RT]/Y.$$

For all LT dominant conditions, the coefficient A1 has a value of one, and the coefficient A2 is the ratio of the magnitudes of RT to LT. The opposite is true for all RT dominant input signal conditions. The domain of each of the two coefficients is from 0 to 1 inclusive. Multiplying LT by [RT]/Y and RT by [LT]/Y produces equal magnitude signals at the output of each of multipliers 31 and 32. If the normalization function is the result of a broadband measurement of the spectrum at LT and RT, then summing the modified signal will not, in all cases, produce the encoded center channel or surround channel signal because the sum signal or difference signal may yet contain information for reproduction by the left (or right) channel signal.

For example, consider encoding the center and left channel signals as two sine waves of arbitrary frequency. If the left channel signal L is 5 kHz, and the center channel signal is a 1 kHz signal, each with a unit amplitude of 1 at the encoder output terminals, since the left channel signal is the greater of the left and right channel signals, the coefficient A1 has a value of 1, and the coefficient of A2 has a value 0.707. Thus, the output of sum multiplier 31 is 0.707 (5 kHz sine wave+1 kHz sine wave) and the output of right multiplier 32 is 1 (1 kHz sine wave). The sum and the difference signals obtained in this example both contain 0.3535 (5 kHz sine wave), which originated as a left channel signal and not as a center or surround channel signal.

Now compare the results of this example with those obtained when the two signals are of the same frequency and phase. In this example, A1 has a value of 1, and the coefficient A2 has a value of 0.5. The resulting outputs of left multiplier 31 and right multiplier 32 are equal, with a unit amplitude of 1. In this example, the sum of the signals and the absence of a difference signal are expected conditions and accurately represent the information in the signals originally encoded.

It has been discovered that the distinction between these and similar examples resides in the indication (or absence) of a difference signal. Stated in general terms, the difference signal obtained when the spectrum is sum signal and left (or right) channel dominant, contains some of the left (or right) channel signal. Similarly, the sum signal obtained when the spectrum is difference signal dominant and left (or right) channel dominant contains some of the left (or right) channel signal. The invention takes advantage of this property to remove the undesired signal from the resulting sum and difference signals furnished by sum and difference summers 33 and 34.

Figure 3A:
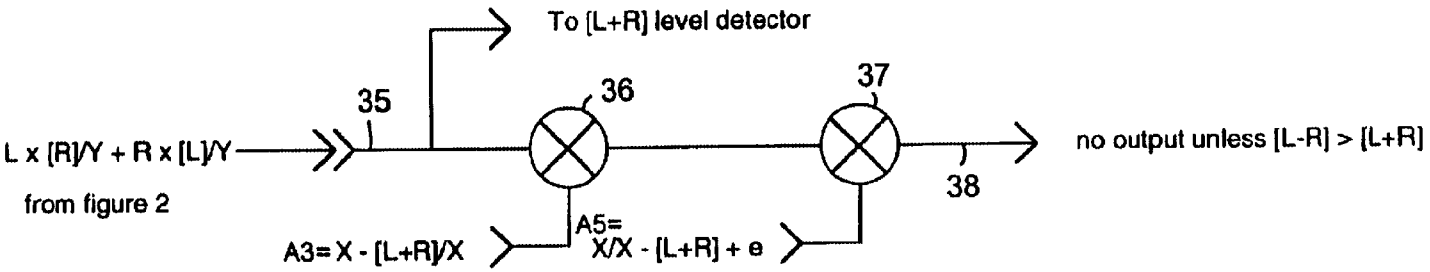
FIGS. 3A and 3B are block diagrams illustrating the logical arrangement for generating a difference signal output for sum signal dominance and a sum signal output for difference signal dominance, respectively.
Figure 3B:
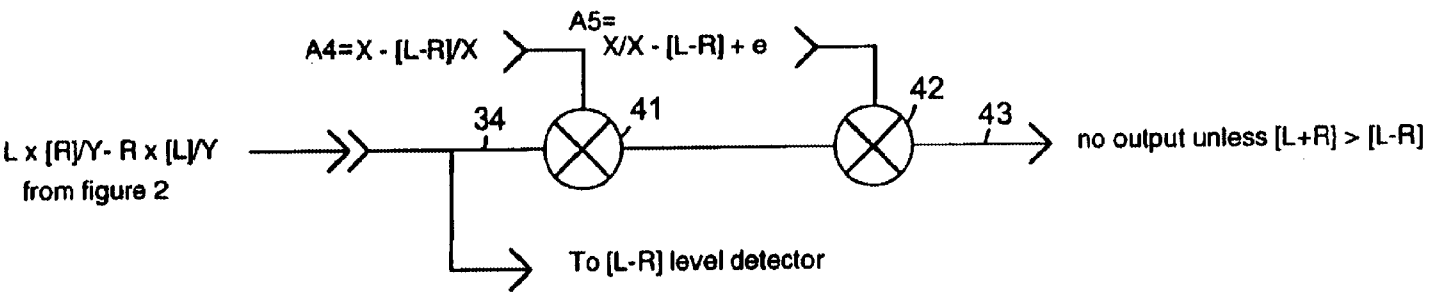

Referring to FIGS. 3A and 3B, there is shown the logical arrangement of apparatus for generating a difference signal output for sum signal dominance and a sum signal output for difference signal dominance.

It is convenient to establish the condition of sum or difference signal dominance by deriving the time-averaged magnitude of each of these signal quantities, and the time-averaged magnitude of whichever of the two is greater (herein referred to as X) when [L−R]≠[L+R]. When [L+R]=[L−R], X is the time-averaged magnitude of either [L+R] or [L−R]. Expressing the sum and difference magnitudes in terms of X produces the coefficients [L+R]/X and [L−R]/X, respectively. For all sum signal dominant conditions, the coefficient [L+R]/X has a value of one, and the coefficient [L−R]/X is the ratio of the difference signal to sum signal magnitudes. The opposite is true for all difference signal dominant conditions. Rearranging these coefficients into a useful form produces:

$$A3=1-[L+R]/X,=(X-[L+R])/X$$

$$A4=1-[L-R]/X,=(X-[L-R])/X$$

The domains A3 and A4 are from zero to one, inclusive. For all sum signal dominant conditions, the coefficient A3 is zero, and the coefficient A4 is 1 minus the ratio of the difference signal magnitude to the sum signal magnitude. The opposite is true for all difference signal dominant conditions. Both A3 and A4 are zero when [L+R] is equal to [L−R]. Multiplying the sum signal and difference signal by A3 and A4, respectively, produces only some of the difference signal when the spectrum is sum signal dominant, and only some of the sum signal when the spectrum is difference signal dominant. By multiplying the resulting output signals by the complement of each coefficient A3, A4, undesired signal components may be removed. It is convenient to designate these complementary coefficients as A5 and A6. Thus:

$$A5=X/[[L+R]-X]+e$$

$$A6=X/[[L-R]-X]+e$$

The quantity e is a small quantity added for theoretical consideration to avoid division by zero. Multiplying the sum signal by A3×A5 and the difference signal by A4×A6 produces only the difference signal (when one is present) when the spectrum is sum signal dominant, and only the sum signal (when one is present) when the spectrum is difference signal dominant.

FIG. 3A implements this process with input multiplier 36 multiplying the signal on line 35 by coefficient A3 to provide a first product signal that is multiplied in output multiplier 37 by coefficient A5 to provide no output on line 38 unless [L−R]>[L+R].

Similarly, in FIG. 3B input multiplier 41 multiplies the signal on line 34 by a signal related to coefficient A4 to provide a first product signal that is multiplied in output multiplier 42 by a coefficient signal A6 to provide no output on line 43 unless [L+R]>[L−R].

To remove the undesired signals present in the sum and difference signals, LT and RT must be unequal. Thus, the invention includes means for disabling signal removal when LT=RT.

Figure 4:
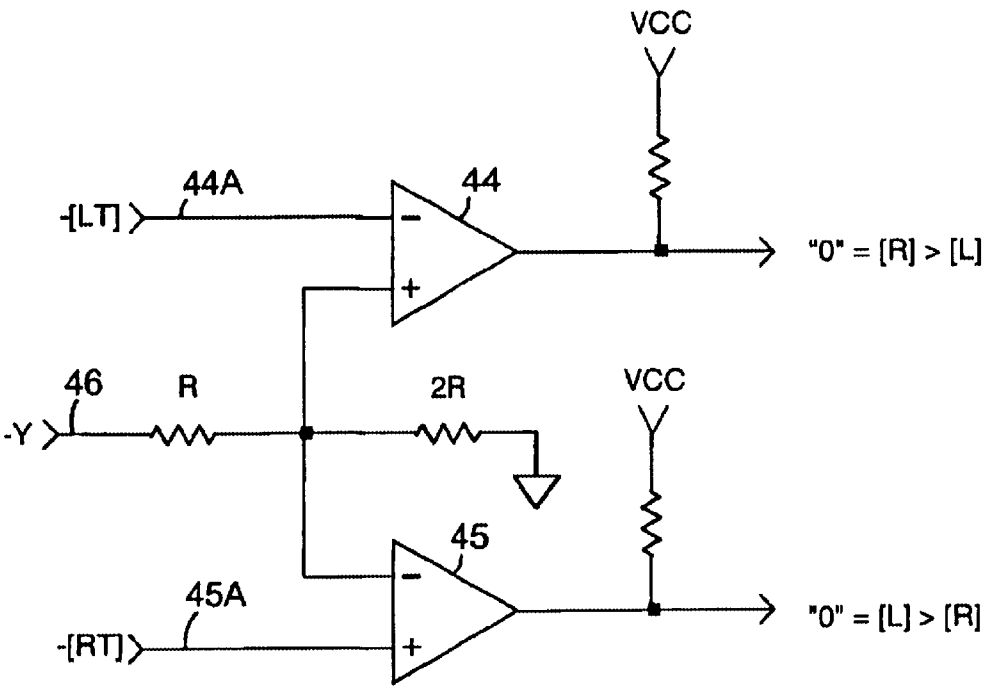
FIG. 4 is a schematic circuit diagram of circuitry for generating the left or right dominant control signal.

Referring to FIG. 4, there is shown a schematic circuit diagram of apparatus for generating the left or right dominant control signal. Left and right comparators 44 and 45 receive signals on inverting inputs 44A and 45A representative of the negative magnitude of LT and RT, respectively. Resistor R couples the negative Y signal on terminal 46 to the noninverting inputs of comparators 44 and 45. The attenuating network formed by these resistors of value R2 and R lightly attenuate the magnitude of the inverted variable signal Y, thereby providing a reliable dead band such that the output of both comparators 44 and 45 are logical 1 when the magnitudes of LT and RT are equal.

The output of left comparator 44 is at logical 0 when the spectrum is RT dominant. The output of right comparator 45 is at logical 0 when the spectrum is LT dominant. The outputs of comparators 44 and 45 gate multipliers (FIG. 5) from full on to cutoff.

Figure 5A:
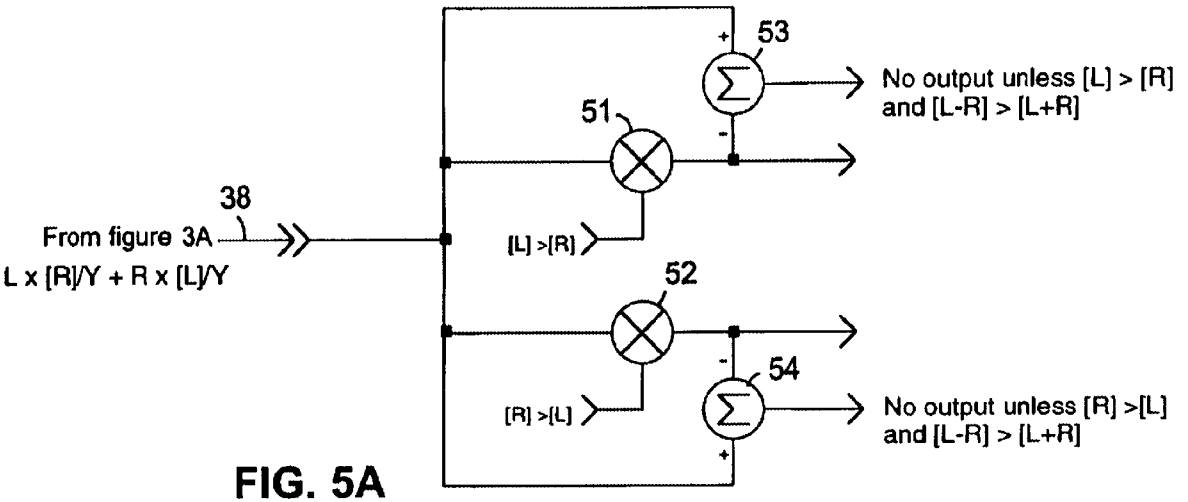
FIGS. 5A and 5B are block diagrams illustrating the logical arrangements for generating sum and difference adjacent channel signals, respectively.

Referring to FIG. 5A, there is shown a block diagram illustrating the logical arrangement for apparatus for generating the sum or difference adjacent channel signal. The voltage gain of the multiplier circuitry is responsive to the comparator circuitry of FIG. 4 such that all multipliers have a voltage gain of unity for the condition LT and RT are equal. For the condition [LT]>[RT], the multipliers connected to the output of comparator 45 are cutoff leaving the multipliers connected to comparator 44 at a gain of unity. The opposite is true for the condition [RT]>[LT]. Subtracting the input of the multipliers from the output of the multipliers produces the desired signals which are combined with the original sum and difference signals to produce modified sum and difference signals which are free of the left or right channel signals.

Thus, line 38 from FIG. 3A is coupled to the inputs of multipliers 51, 52 and the + input of combiners 53 and 54, respectively. The outputs of multipliers 51 and 52 are connected to the − input of combiners 53 and 54, respectively. The other inputs of multipliers 51 and 52 are coupled to the outputs of comparators 44 and 45, respectively. Thus, combiner 53 produces no output unless both [L]>[R] and [L−R]>[L+R], and combiner 54 provides no output unless both [R]>[L] and [L−R]>[L+R].

Similarly, output 43 from FIG. 3B is coupled to an input of multipliers 55 and 56 and the + inputs of combiners 57 and 58, respectively. The outputs of multipliers 55 and 56 are coupled to the − inputs of combiners 57 and 58, respectively. The other inputs of multipliers 55 and 56 are coupled to the outputs of comparators 44 and 45, respectively. Thus, combiner 57 provides no output unless [L]>[R] and [L+R]>[L−R], and combiner 58 provides no output unless [R]>[L] and [L+R]>[L−R].

Figure 5B:
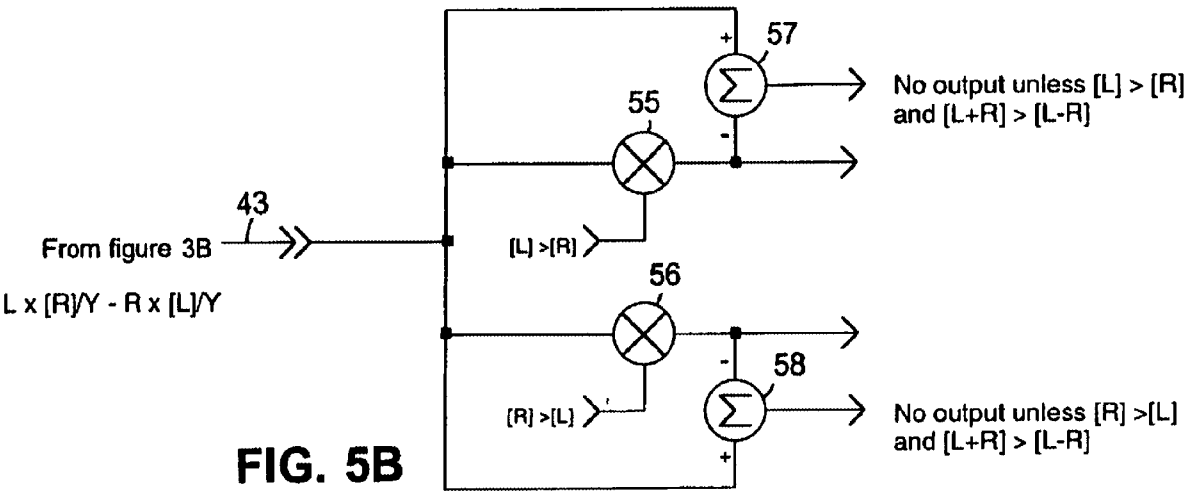

Referring to FIG. 5B, there is shown added to the system of FIG. 5A, sum output combiner 61 and difference output combiner 62 each having five inputs added and subtracted as indicated to provide a modified sum signal on output 63 and a modified difference signal on output 64 free of the left or right channel signals.

Figure 5C:
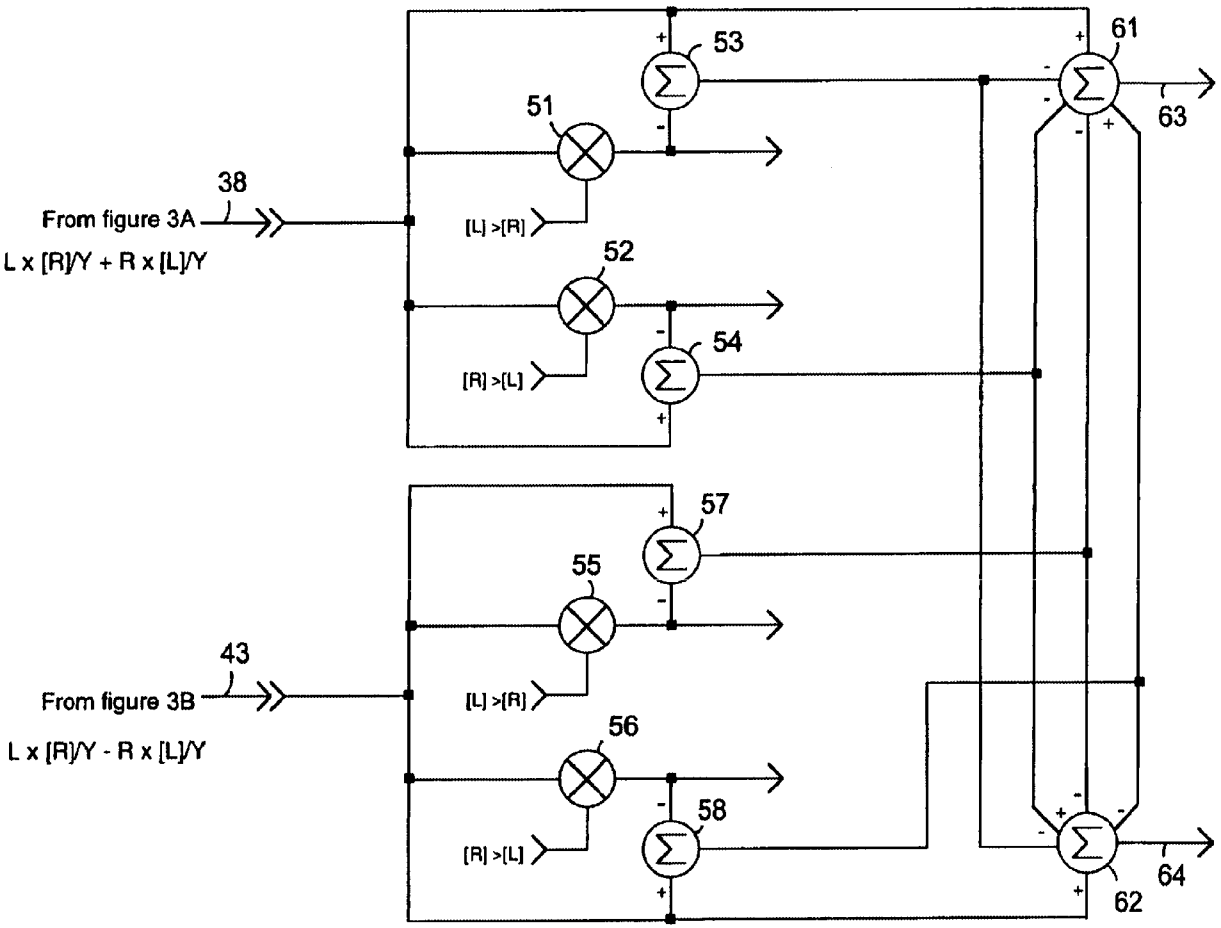
FIG. 5C is a block diagram illustrating the logical arrangement of apparatus for removing the adjacent channel signal from the sum and difference signals.

Referring to FIG. 5C, there is shown a block diagram illustrating the logical arrangement of a system for removing the adjacent channel signal from the sum and difference signals.

Referring again to FIG. 1, consider the left transmitted signal LT and the right transmitted signal RT on lines 24 and 25, respectively, when the encoded signals are applied as arbitrary sine waves to the center and surround terminals 12 and 14, respectively. Consider the center channel signal being 1 unit of a 1 kHz sine wave as measured at the outputs 25 and 29. Consider that the surround channel signal is 1 unit of a 5 kHz sine wave as measured at the output terminals 24 and 25. In this example, the magnitude of LT is equal to RT and the sum signal magnitude is equal to the difference between signal magnitudes. The resulting sum and difference signals provided by the system of FIG. 2 accurately reflect the original signal that was encoded.

Now consider signal conditions at the center and surround input terminals 12 and 14 resulting in sine waves of the same frequency and amplitude on outputs 25 and 29, such as 1 unit of 1 kHz sine waves. These output signals are in phase quadrature, the magnitudes of these signals are equal and the magnitude of their sum is equal to the magnitude of their difference. However, the sum and difference signal components contain some left and right channel information.

By further processing the sum and difference signals according to the invention, the correct amount of left and right channel information remains in the transmitted signals LT and RT after the sum and difference signal components (representing the center and surround signals) have been removed from LT and RT.

When the two output signals are in phase quadrature, the encoded signals processed by the decoder should appear at all output terminals of the decoder with equal amplitude at each output terminal; that is, left, right, center and surround. By adding to the left channel and right channel signals equal predetermined amounts of sum and difference signal, the correct amount of left and right channel information remains in the left and right channels.

Figure 6:
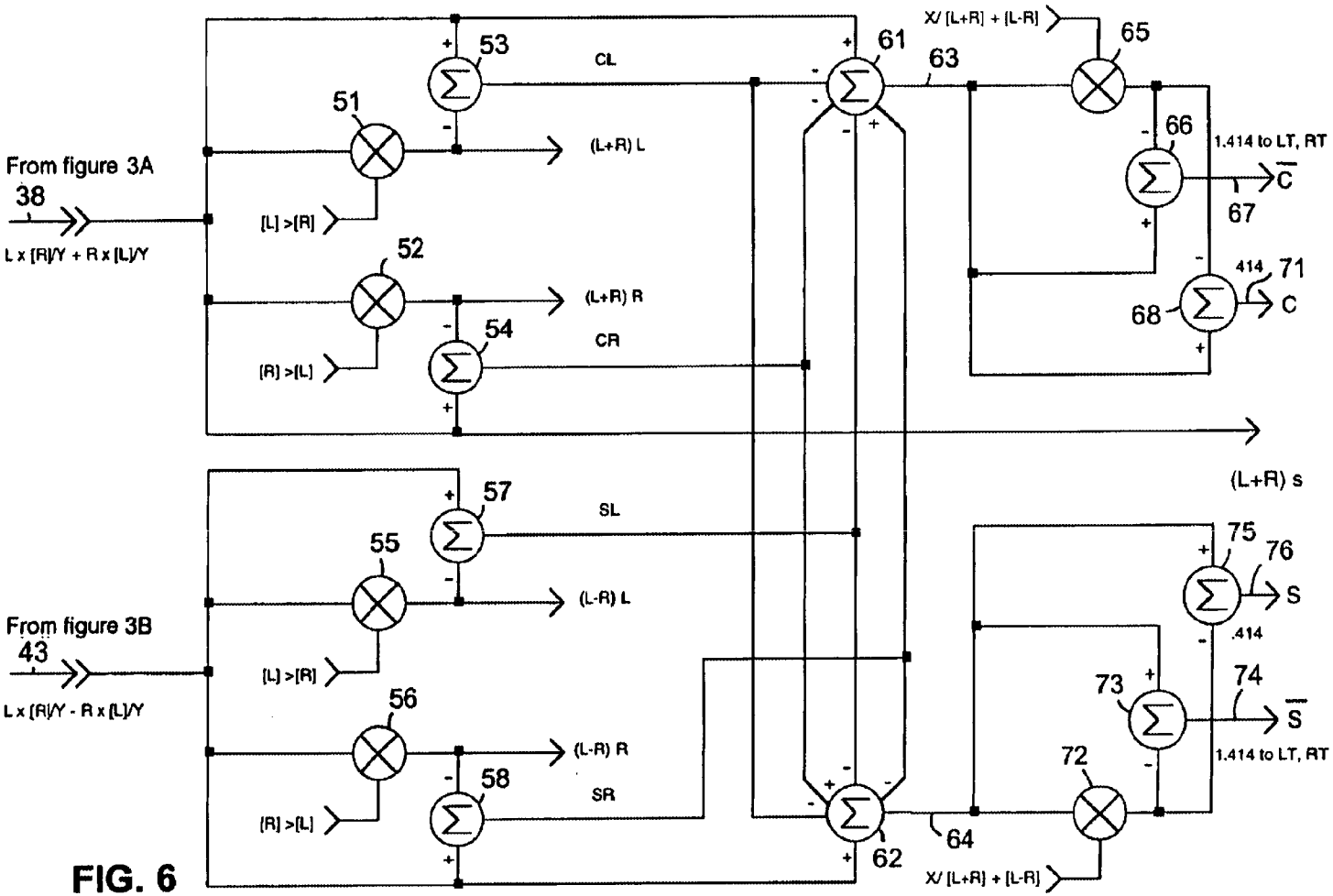
FIG. 6 is a block diagram illustrating the logical arrangement for normalizing the matrix for quadrature encoded signals.

Referring to FIG. 6, there is shown a block diagram of the circuitry of FIG. 5B with additional components added to assure proper decoding when the sine wave signals on output terminals 25 and 29 are in phase quadrature and of equal amplitude caused by signals applied to the center and surround inputs 12 and 14, respectively. Center multiplier 65 has one input coupled to left output combiner 61 and the other input receives a signal related to the ratio of X to the sum of the magnitudes of the sum and difference signals to provide a product signal that is differentially combined with the output of left output combiner 61 to provide a center complement signal by combining complement center combiner 66 to provide the center complement signal $\overline{C}$ on line 67 that is differentially combined with the signal on line 63 in combiner 68 to provide the center signal C on line 71.

Similarly, surround multiplier 72 has one input coupled to the output 64 of right combiner 62 and the other input receives the same signal applied to the other input of center multiplier 65 to provide a product signal that is differentially combined with the signal on line 64 to complement surround combiner 73 to provide the surround complement signal $\overline{S}$ on line 74 that is differentially combined with the signal on line 64 in surround combiner 75 to provide the surround signal S on line 76.

Consider still another situation wherein the signal on output terminal 29 includes 1 unit of 5 kHz sine wave and the signal on output terminal 25 includes 1 unit of 1 kHz sine wave caused by a left channel signal on line 11 and right channel signal on right input terminal 13. This third situation is indistinguishable from the previous two. For a broad spectral band it has been discovered that under these conditions it is desirable to maintain the relevant relationship of the sum and difference signals with respect to each other. Any manipulation of the sum and difference signals for subtracting these signal quantities from the transmitted LT and RT as the center and surround signals will result in a degradation of the separation from the left channel to the right channel and right channel to left channel if the relationship of the sum and difference signals (with respect to each other) are not carefully controlled according to the invention.

According to the invention, multipliers 65 and 72 multiply the processed sum and difference signals furnished by the system of FIG. 5A by the following common coefficient signals $\overline{C}$ and $\overline{S}$ corresponding to coefficients A7 and A8 related as follows:

$$A7=(1-X/[L+R]+[L-R])\times 1.414=\bar{C}$$

$$A8=(1-X/[L+R]+[L-R])\times 1.414=\bar{S}$$

The sum and difference signals at the output of center complement combiner 67 and surround complement combiner 73 are each added to LT ($\overline{C}+\overline{S}$) and are added with and subtracted from RT, ($\overline{C}-\overline{S}$) which restores to LT and RT some L and R, respectively. Similarly, some of the resulting signals $\overline{C}$ and are removed from the sum and difference signals. If [L+R]=[L−R], the amount of signals added to LT and RT is 0.707L and 0.707R, respectively.

When the spectrum of LT and RT is purely in-phase monophonic spectral components, no signal is added to LT and RT. The same is true when the spectrum at LT and RT is purely out-of-phase monophonic components. To complete the basic decoding process, the final sum and difference signals are multiplied (post matrix) by 1.414 for basic adaptive matrix decoding with a singular surround channel. Performing the signal processing in each of the three previous illustrations in individual spectral bands recovers the signals originally encoded.

There has been described apparatus and techniques which overcomes a basic limitation of conventional decoding techniques when attempting to decode two adjacent channel signals simultaneously, and in particular, removed the center C and surround S components from LT and RT without significant degradation of the left/right separation. Furthermore, by processing in accordance with the invention in an adequate number of spectral bands, the invention accurately decodes the encoded signals.

Referring again to FIG. 2 and coefficients A1, A2, multiplying the decoded surround channel signal S by these coefficients effectively adds directional capability to the monaural surround signal S. It is possible to have a surround channel signal and a left and right channel signal simultaneously.

Consider encoding a monaural surround and left channel signal of equal amplitude as provided at the LT and RT terminals 24 and 25, respectively. The LT output then contains 1 unit of left channel information, and the LT and RT output terminals 24 and 25, respectively, each contain 1 unit of surround channel information. Since the relative amplitudes of the LT and RT signals differ by 6 dB, and the signal on the LT input terminal 24 is dominant, the coefficient A1=[LT]/Y is unity, and the coefficient A2=[RT]/Y is 0.5. The decoded difference signal then has a magnitude of 1 unit of surround channel information, which, when removed from LT and RT, leaves 1 unit of left information in the left channel.

Figure 7:
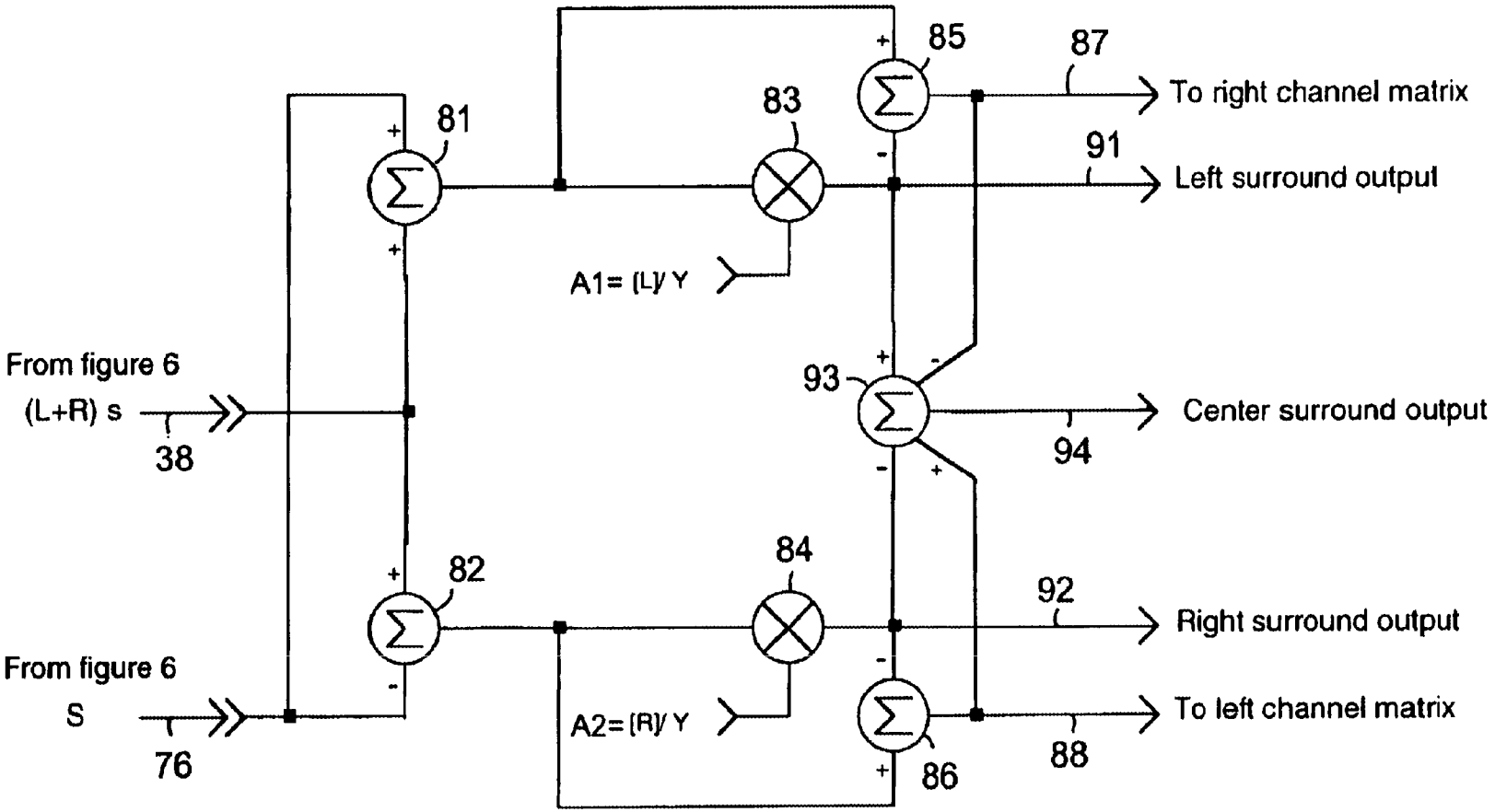
FIG. 7 is a block diagram illustrating the logical arrangement for generating left, center and right surround channel signals.

Referring to FIG. 7, the left and right surround channels are respectively LS=S×[L]/Y and RS=S×[R]/Y.

Recall that the behavior of the coefficients is such that for all LT dominant conditions, A1 =[L]/Y is unity and A2=[R]/Y is the ratio of the RT input to LT input signals. Thus, a 6 dB difference in input signal levels at the input terminals of the decoder produces a 6 dB difference in the left and right surround channel signals. The invention achieves this result, not by raising the relative level of the dominant surround channel, but by decreasing the level of the benign channel. This property prevents unnatural increases in surround channel signal level that would otherwise occur if the dominant surround signal level were increased. The resulting surround channel signals (from the preceding example) are 1 unit of surround channel information in the left surround channel, and 0.5 of surround channel information in the right surround channel. In FIG. 7, combiner 81 cumulative combines the sum of the signals from combiners 57 and 58 in FIG. 6 with the surround signal S on line 76 of FIG. 6 and combiner 82 differentially combines these signals. Multipliers 83 and 84 multiply the output signals of combiners 81 and 82 with coefficient signals A1 and A2, respectively, to provide respective product signals differentially combined with the signals from combiners 81 and 82, respectively, by combiners 85 and 86, respectively, to provide the right channel matrix signal on line 87 and the left channel matrix signal on line 88. Multipliers 83 and 84 furnish the left surround output and right surround output signals on lines 91 and 92, respectively. Center combiner 93 combines the left and right surround output signals and the right channel matrix and left channel matrix signals to provide the center surround output signal on line 94.

In the previous illustration, the surround channel signal is decidedly dominant. It is advantageous to have the left surround channel dominant over the left front channel. By performing the operations 1−LS =R and 1−RS=L, it is possible to remove from the dominant front channel the signal which appears as either L or R, and thereby improve the separation between the dominant front and rear channels. For the previous example, 1−LS is 0, and 1−RS furnishes 0.5 units of surround channel signal information. Subtracting this quantity from the left front channel signal decreases the left front channel signal to 0.5 units of left front channel information and effectively places the left rear channel in dominance by 6 dB over the left front channel and right surround channel, respectively. The process is symmetrical for a surround dominant and right channel signal combination. The illustration above is the asymptotic condition, (6 dB left to right surround channel separation with 6 dB dominant rear to dominant front channel separation) because any additional LT or RT dominance results in a diminished surround channel signal.

The directional capability of the surround channel signals is a significant improvement. Still another feature of the invention improves spatial realism of the left/right surround channels by the modified circuitry shown in FIG. 8 and by adding, in matrix fashion, sum signal components to the surround channel signal.

Figure 8:
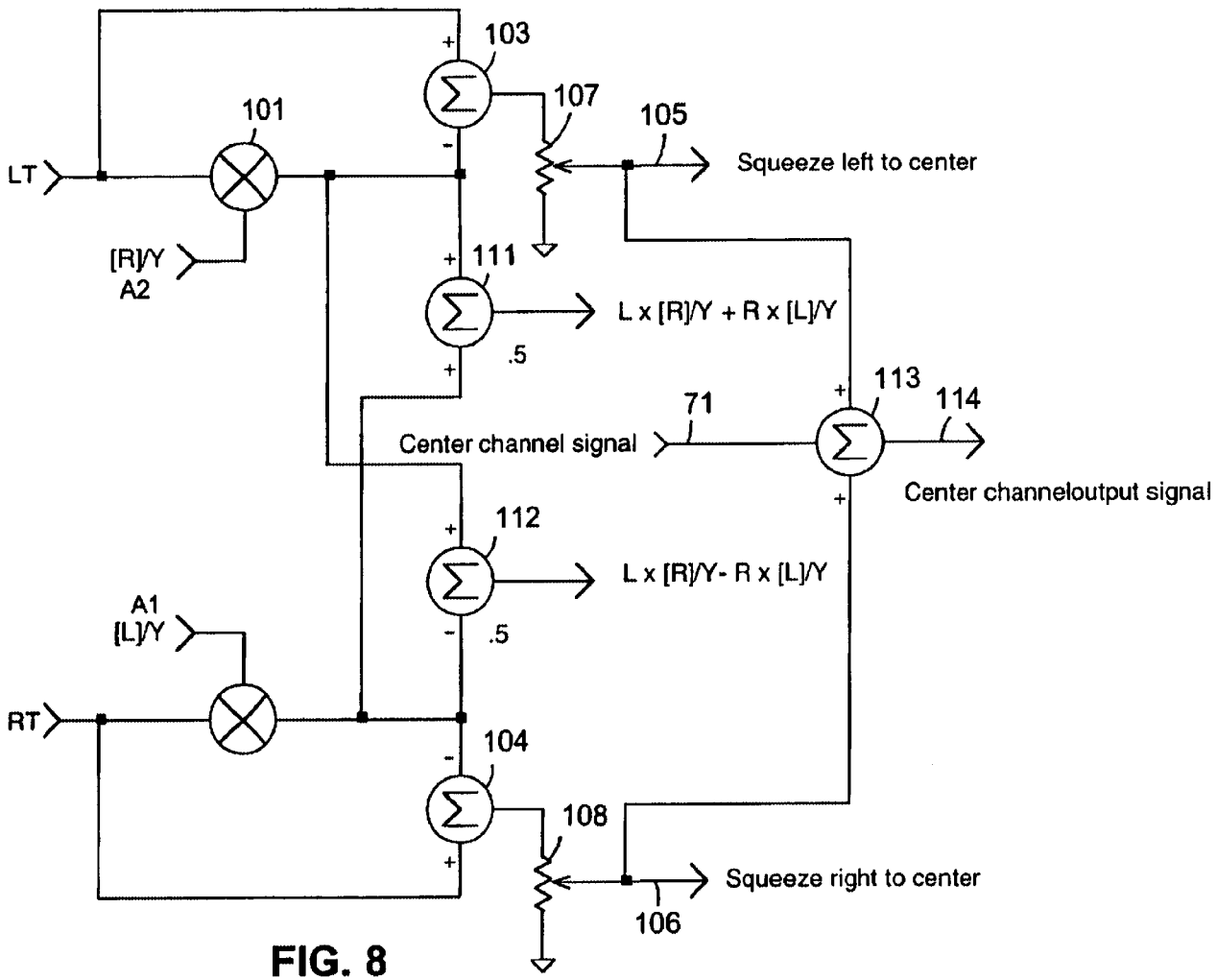
FIG. 8 is a block diagram illustrating the logical arrangement for generating left/right squeeze signals.

With reference to the coefficient A3, recall that this coefficient has a value of 0 for all sum signal dominant conditions, and is essentially 1 minus the ratio of the sum signal to the difference signal for all difference signal dominant conditions. In the limit, for a pure difference signal condition, there is no sum signal content in the spectrum. It is thus inconsequential to matrix the sum signal with the difference signal then. When the spectrum is sum signal dominant, the output of the multiplier is zero, and again, there is no sum signal component to matrix with the difference signal component. This property is highly advantageous because there is no sum signal matrix with the difference signal when the signals LT and RT are primarily monaural or dialog dominant typically occurring for voices originating from the stream of a video display. As the spectrum becomes difference signal dominant, there is less sum signal content, and it is advantageous to matrix increasing amounts of sum signal spectrum with the increasing dominant difference signal spectrum. In FIG. 8, multipliers 101 and 102 multiply the LT and RT signals respectively by the coefficient signals A2 and A1, respectively, to provide product signals differentially combined by combiners 103 and 104, respectively, with the LT and RT signals, respectively, to provide the squeeze left to center and squeeze right to center signals respectively on lines 105 and 106, respectively, through potentiometers 107 and 108, respectively.

Combiner 111 cumulatively combines the product signals provided by multipliers 101 and 102, and combiner 112 differentially combines these signals to provide the indicated output signals.

Combiner 113 cumulative combines the center channel signal on line 71 with the squeeze left to center and squeeze right to center on lines 105 and 106, respectively, to provide the center channel output signal on line 114.

The left and right surround channels are out-of-phase. If A1 equals A2, the matrix sum signal appears common mode at the output of the left and right surround outputs on lines 91 and 92 when the left and right surround channels are subtracted from each other. This property is an advantageous characteristic of the center surround channel because the signal is predominantly monaural and unique relative to the left and right surround channels. The circuit arrangement maintains the output amplitude of the center surround channel always equal to the output amplitude of the lesser surround channel signal (left or right). The output amplitude of the center surround channel signal is equal in amplitude to the left and right surround channel signals when A1 equals A2. In the limit, the output of the center surround channel is zero for an exclusive LT or RT signal input although there is no surround channel signal for either of these conditions.

These considerations make the derived center surround channel according to the invention very suitable for use with 5.1 channel discrete source material. The original 5.1 channels are matrixed as indicated in the block diagram of FIG. 9 to form the transmitted signals LT and RT and may be applied to the decoding circuitry. When the decoder circuitry is used to decode these signals, only the center surround channel and derived bass signals are used as actual output signals from the decoder. The originating left, right, center, left surround and right surround signals are used in place of the output signals from the matrix decoder, augmented by the center surround channel signal and the bass signal outputs of the decoder.

Figure 9:
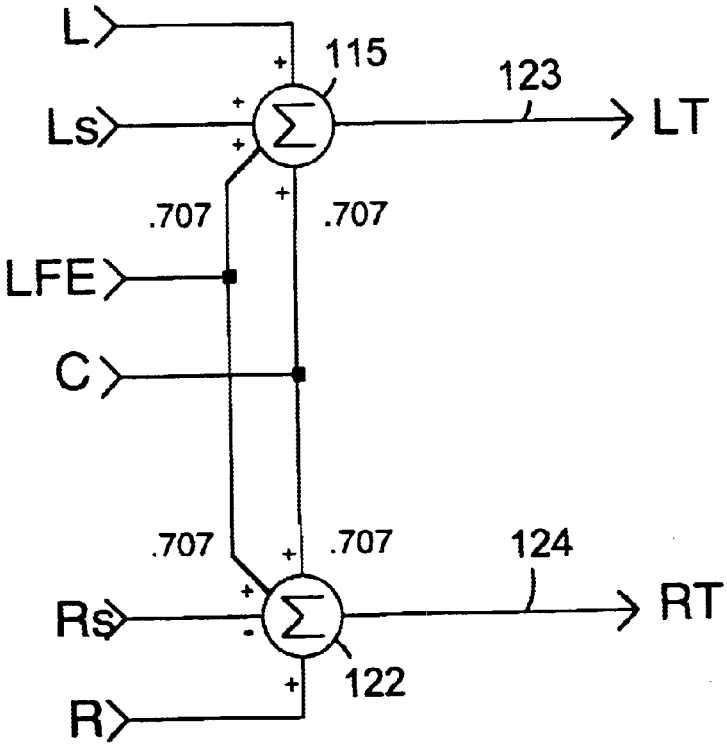
FIG. 9 is a block diagram illustrating the logical arrangement for matrixing the discrete 5.1 channel source media signal to derive the center surround channel signal and bass channel signal.

In FIG. 9, left input combiner 115 cumulatively combines the left signal, the left surround signal, 0.707 of the low frequency effects (LFE) signal and 0.707 of the center channel signal to provide the left transmitted signal LT on line 123. Right signal combiner 122 cumulatively combines the right signal, 0.707 of the center channel signal, 0.707 of the LFE signal and differentially combines the sum of these signals with the right surround channel signal to provide the right transmitted signal RT on line 124.

Figure 10:
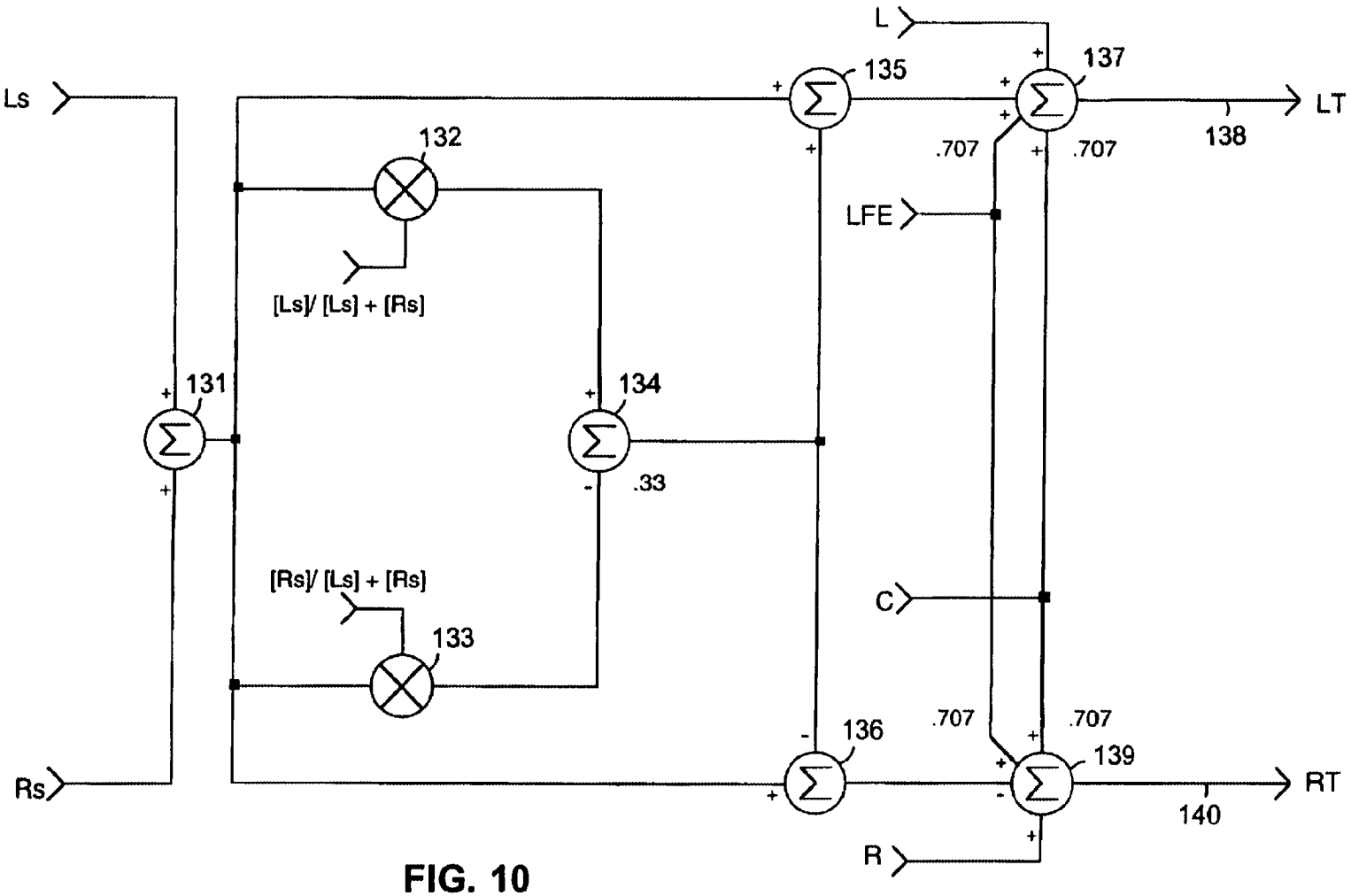
FIG. 10 is a block diagram illustrating the logical arrangement for modified matrix encoding with split surround channel signals.

Referring to FIG. 10, there is shown a block diagram illustrating the logical arrangement of a modified matrix encoder with split surround channels. Surround input combiner 131 cumulatively combines the left surround and right surround signals LS and RS to provide a sum signal that is applied to multipliers 132 and 133 multiplied by the ratio of the time-averaged magnitudes of the left and right surround signals, respectively, to the sum of these time-averaged magnitudes to provide product signals that are differentially combined by combiner 134. Combiner 135 cumulatively combines .33 of the output signal of combiner 134 with the signal from combiner 131, and combiner 136 differentially combines .33 of the output signal of combiner 134 with the signal from combiner 131. Left output combiner 137 cumulatively combines the left channel signal, the output signal of combiner 135, 0.707 of the LFE signal and 0.707 of the center channel signal to provide the left transmitted signal LT on line 138. Combiner 139 cumulatively combines 0.707, the center channel signal, 0.707 of the LFE signal, and the right channel signal differentially with the output of combiner 136 to provide the right transmitted signal RT on line 140.

Figure 11:
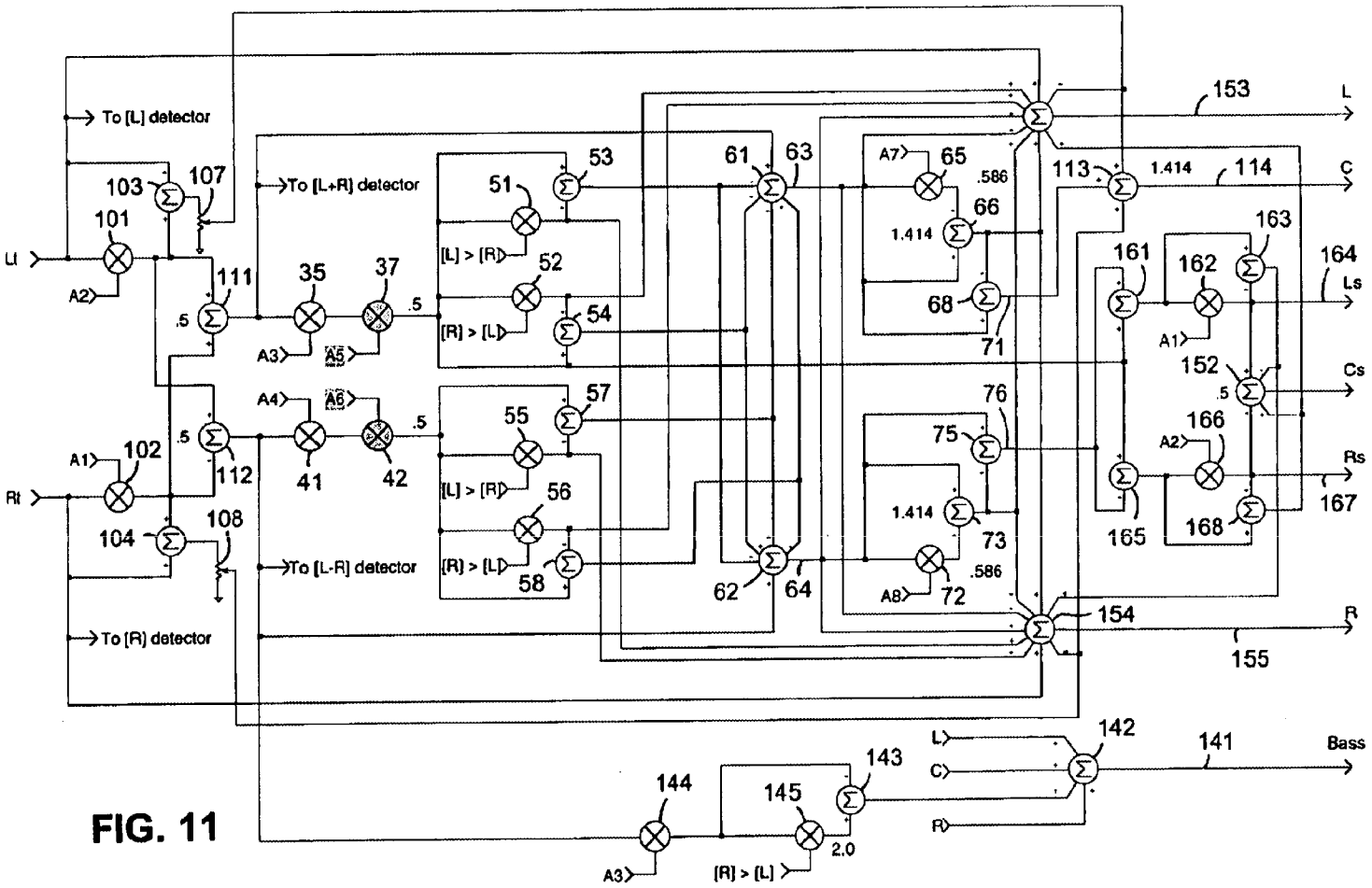
FIG. 11 is a block diagram illustrating the logical arrangement of a broadband block decoder.

Referring to FIG. 11, there is shown a broadband block decoder according to the invention that includes an assembly of apparatus described above. Corresponding elements in FIG. 11 and the other figures are identified by corresponding reference symbols. The additional components not described above furnish the bass signal on line 141 at the output of combiner 142. Combiner 142 cumulatively combines the decoded left, right and center channel signals with the output of combiner 143 that differentially combines the output of multiplier 144 with the product signal furnished by multiplier 145 that multiplies the latter product signal with the signal indicating that the magnitude of the right channel signal is greater than that of the left channel signal. Multiplier 144 provides a product signal that is the product of the coefficient A3 signal with the output of combining network 112 (see FIG. 8).

Left output combiner 152 differentially combines the left squeeze signal from the arm of potentiometer 107, cumulatively combines the LT signal, the signal from multipliers 52 and 56, differentially combines the signals from combiner 66 and 63 and center surround output combiner 152 to provide the L signal on output 152. Right output combiner 154 differentially combines the right squeeze signal from the arm of potentiometer 108, cumulatively combines the RT signal, differentially combines the outputs of multiplier 55 and combiners 63 and 66 and cumulatively combines the outputs of multiplier 51, combiner 62, combiner 66 and center surround output combiner 152 to provide the right output signal on line 155.

Left input surround combiner 161 cumulatively combines the signals from combiner 75 and multiplier 37 to provide a sum signal that is multiplied by the coefficient A1 in multiplier 162 and differentially combined in left output combiner 163 with the output product signal from multiplier 162 to provide a left surround sum signal that is differentially combined in center surround output combiner 152. The output of multiplier 162 is the left surround signal LS on line 164.

Right input surround combiner 165 differentially combines the signal from multiplier 37 with the signal from combiner 75 to provide a difference signal that is multiplied by the factor A2 in multiplier 166 and differentially combined with the output of multiplier 166 that is the right surround signal RS on line 167 in right surround output combiner 168 to provide a difference signal that cumulatively combined in center surround output combiner 152 that also differentially combines the right surround signal and cumulatively combines the left surround signal on lines 167 and 164, respectively, to furnish the center surround signal as an output on line 168.

Referring to FIG. 8, for all signal conditions where the time averaged magnitude of LT is equal to the time averaged magnitude of RT, the coefficients A1 and A2 are equal and have a value of unity. Thus, $LT \times 1 - A2 = 0$ and $RT \times 1 - A1 = 0$.

It follows that there is no squeezable contribution of the left total input signal or right total input signal to the decoded center channel output, and that there is no corresponding reduction in the decoded left or right channel output signals. However, when the time averaged magnitude of LT is greater than the time averaged magnitude of RT, such as occurs with the signal present in LT exclusively, the resulting signals: LT×(1−A2)=LT and RT×(1−A1)=0 are produced. For all LT dominant conditions, the expression RT×(1−A1) is always 0. The opposite is true for all RT dominant conditions.

The outputs of the multiplier cells are fed to independently variable or ganged variable resistors, such as 107 and 108. The variable resistors facilitate adjusting the relative amount of exclusive left/right total input signal information for subtraction from the decoded left and right channel output signals and added to the decoded center channel output signal. For example, placing equal amounts of left channel information in the center and left channel loudspeakers produces a virtual loudspeaker midway between the center and left channel loudspeakers, thereby placing the exclusive left channel apparent speaker location closer to the video display device. Varying the relative amount of exclusive left channel information removed from the decoded left output channel and added to the decoded center channel output channel serves to vary the apparent location of the virtual loudspeaker. The same condition exists for the exclusive right channel information. In this way, it is possible to place the virtual loudspeakers closer to the display device, such as a television screen, and thus maintain a reasonable relationship between the visual and acoustic images. This technique is advantageous for home theater applications where the left and right channel loudspeakers are placed typically well to the left and right of an attending display device and may be asymmetrically placed with respect to the display device.

Returning to FIG. 11, the bass channel output signal is the sum of the decoded left channel, right channel and center channel output signals. In addition, the normalized difference signal obtained from the output of the system of FIG. 2 is applied as one input of a multiplier who second input is the coefficient A3. Thus, $$(LT\times[R]/Y-RT\times[L]/Y)\times X-[L+R]/X$$

produces an output signal only when the time averaged magnitude of the normalized sum signal is less than that of the normalized difference signal. Under these conditions, the spectrum would contain a dominant surround channel signal, and it is desirable to reproduce a bass signal which contains the dominant surround channel signal. The resulting signal obtained under these conditions, however, is further processed prior to adding it to the sum of the decoded left, right and center channel output signals if the spectrum is simultaneously difference signal dominant and left or right channel dominant. When the spectrum is difference signal dominant and left channel dominant, the processed difference signal is taken as shown in FIG. 11 and added directly to the decoded left, right and center channel output signals. When the spectrum is difference signal dominant and right channel dominant, the processed difference signal is inverted and added to the decoded left, right and center channel output signals. This arrangement excludes destructive summation of the processed difference signal with the decoded (dominant) right channel output signal, and permits reproducing the surround dominant bass signal in the presence of the dominant left or right channel output signal.

Figure 12:
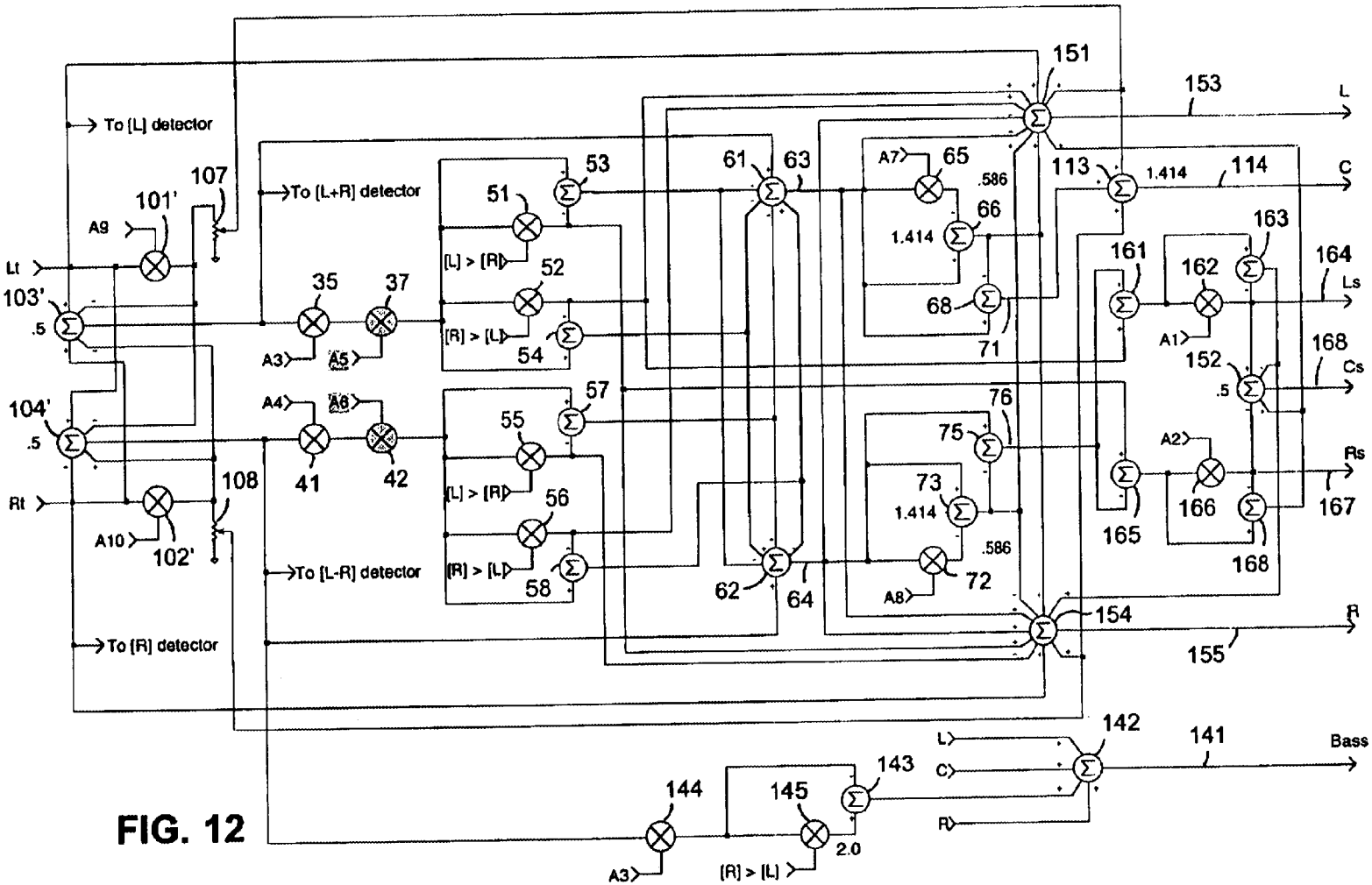
FIG. 12 is a modification of the block diagram of FIG. 11 illustrating the logical arrangement of a broadband block decoder with an enhanced sound imaging feature.

Referring to FIG. 12, there is shown a modification of the broadband block decoder according to the invention shown in FIG. 11 that includes modifications at the input end that avoids sound image collapse to the center under certain conditions that might occur with the embodiment of FIG. 11. This circuitry includes left and right multipliers 101' and 102' for providing a product signal to potentiometers 107 and 108, respectively, representative of the product of the left transmitted signal LT with coefficient signal A9 and the product of the right transmitted signal RT with the coefficient signal A10, respectively. The circuitry also includes left signal combiner 103' for cumulatively combining the left and right transmitted signals LT and RT and subtractively combining the product signals at the outputs of multipliers 101' and 102' to provide a signal representative of the magnitude of the sum of the left and right transmitted signals to multiplier 35 and representative of the magnitude of the difference therebetween to multiplier 41.

The coefficient signals A9 and A10 are defined as follows:

$$A9=(Y-|\bar{R}|)/Y$$

$$A10=(Y-|\bar{L}|)/Y$$

An advantage of this arrangement is that the apparent location of the sound image is initially on the center surround axis that extends between the rear and front of the listening area as distinguished from being on the left-right axis at the front of the listening area. A sudden change in the position of the sound image is significantly less distracting to the listener than an initial sound image on the left-right axis.

Figure 13:
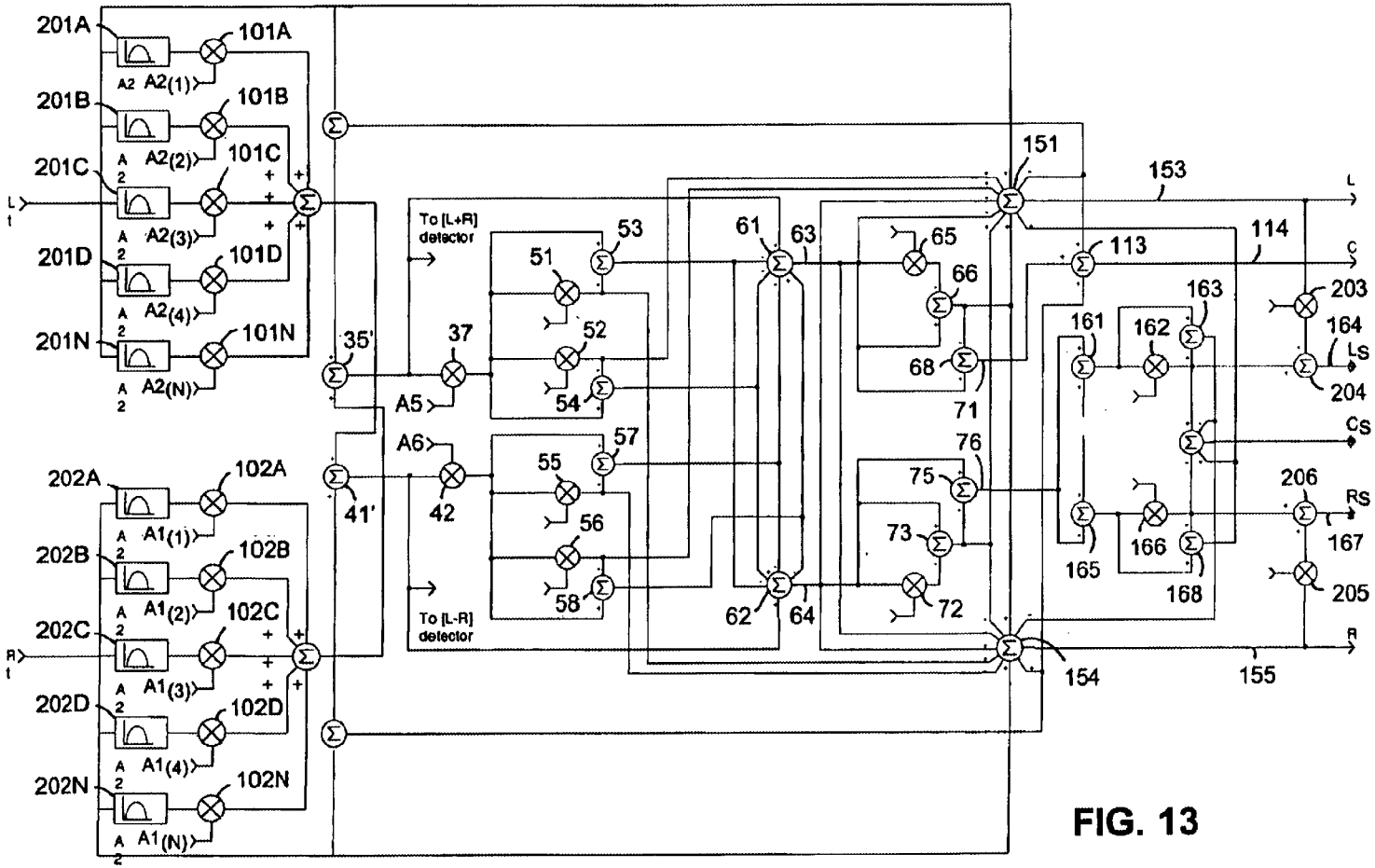
FIG. 13 is a block diagram illustrating the logical arrangement of another modification of the arrangement of FIG. 11 characterized by frequency division.

Referring to FIG. 13, there is shown another embodiment of the invention representing a modification of the system of FIG. 12 constructed and arranged to couple the transmitted signals LT and RT to respective multipliers 101A . . . 101N and 102A . . . 102N, respectively, through filters 201A . . . 201N and 202A . . . 202N, respectively, the filters embracing contiguous frequency bands in the audio frequency range to transmit corresponding spectral components of the left and right transmitted signals LT and RT. The other input of each of these multipliers receive a coefficient signal A21 . . . A2N and A11 . . . A1N, respectively. The output product signals of multipliers 101A . . . 101N energize left combiner 111' to cumulatively combine these signals. The output product signals of multipliers 102A . . . 102N energize respective inputs of right combiner 112' to cumulatively combine these signals. The output of left signal combiner 111' energizes one input of signal combiner 41' that differentially combines this signal with the output of right combiner 112' to provide an output signal to multiplier 42. This signal also energizes one input of combiner 35' whose other input receives the signal from right combiner 112' to cumulatively combine these signals and furnish them to multiplier 37.

This embodiment of the invention also includes circuitry constructed and arranged to include a signal representative of the left output signal on line 153 forming the left surround signal on line 164 coupled through signal combiner 204 which cumulatively combines the product signal from left surround output multiplier 203 with the product output signal of multiplier 162. Left surround multiplier 203 furnishes a product signal related to the product of the left output signal on line 153 with the (|L−R|)/X coefficient signal at the other input. Similarly, there is circuitry constructed and arranged to include in the right surround signal on line 167 a component related to the right output signal on line 155 provided by output right surround multiplier 205 providing a product signal related to the product of the right output signal on line 155 with a (|L−R|)/X coefficient signal to provide a product signal cumulatively combined with the output of multiplier 166 in combiner 206. Injecting right signal and left signal into right surround and left surround signal enhances the stereo image perceived by a listener.

Figure 14:
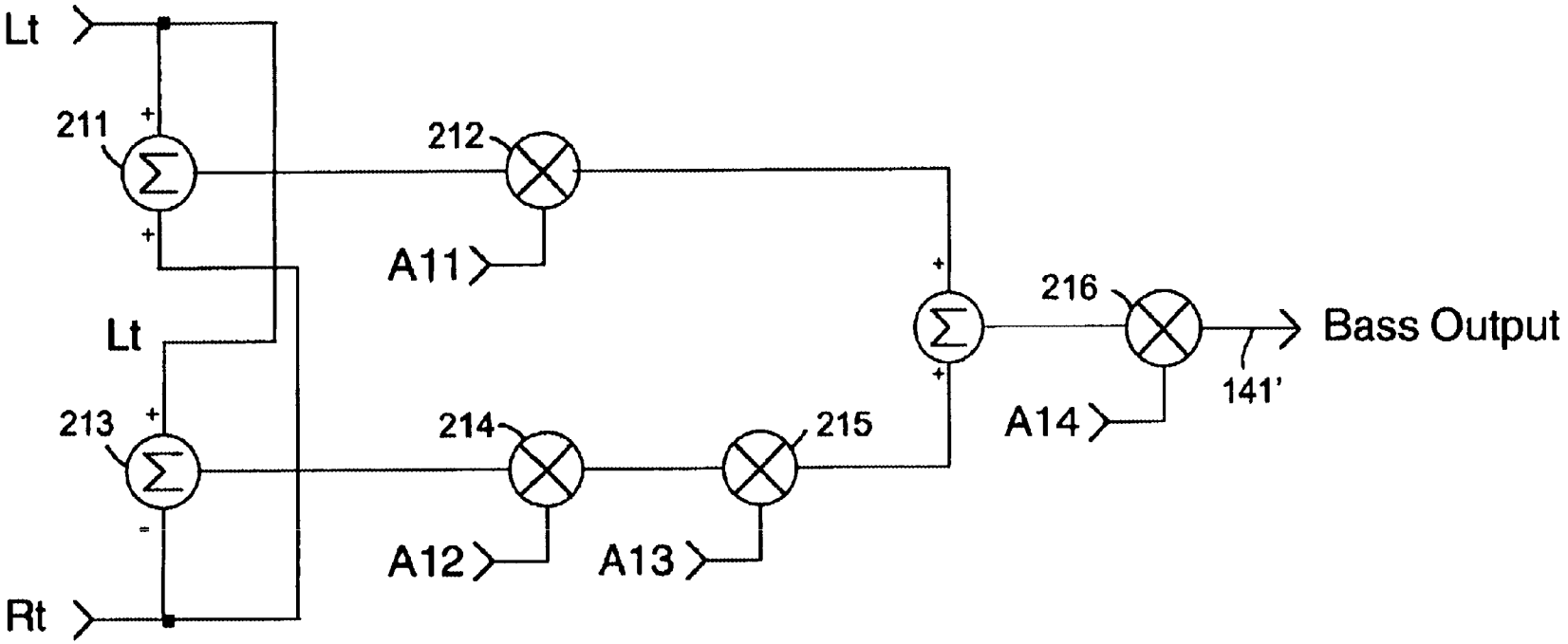
FIG. 14 is a block diagram illustrating the logical arrangement of a system for processing left and right transmitted signals to provide an output bass signal.

Referring to FIG. 14, there is shown an alternative arrangement for providing a bass output signal on line 141'.

A left input combiner 211 cumulatively combines the left transmitted signal LT and the right transmitted signal RT to provide a left combined signal multiplied by an A11 coefficient signal to provide a left product signal by multiplier 212.

Right combiner 213 differentially combines the left transmitted signal LT with the right transmitted signal RT to provide a right combined signal that is multiplied by the A12 coefficient signal in first multiplier 214 to provide a first product signal that is multiplied by the A13 coefficient signal in second multiplier 215 to provide a second product signal that is cumulatively combined with the product signal provided by multiplier 212 to provide a sum signal that is multiplied by the A14 coefficient signal in bass output multiplier 216 to provide the bass output signal on line 141'.

The A11 coefficient signal=

$$\{10\ ([\overline{L+R}]-X)\}+[\overline{L+R}]X$$

The A12 coefficient signal=1−A11.

The A13 coefficient signals is a user selection to establish the surround bass volume to provide a voltage gain of 1 to 3 corresponding to a range in loudness of 0 to 10 db, usually preferred.

The A14 coefficient=

$$\sqrt{|LT|^2+|RT|^2}/X$$

which is approximately equal to $$Y+[Y-\{([\overline{LT}]-[\overline{RT}])\times 0.5\}]/X$$

The circuitry is constructed and arranged so that there is a vector combination of bass components. If the phase angle between surround and main bass components is less than 90°, these components are cumulatively combined. If the phase angle is greater than 90°, these components are differentially combined.

Figure 15:
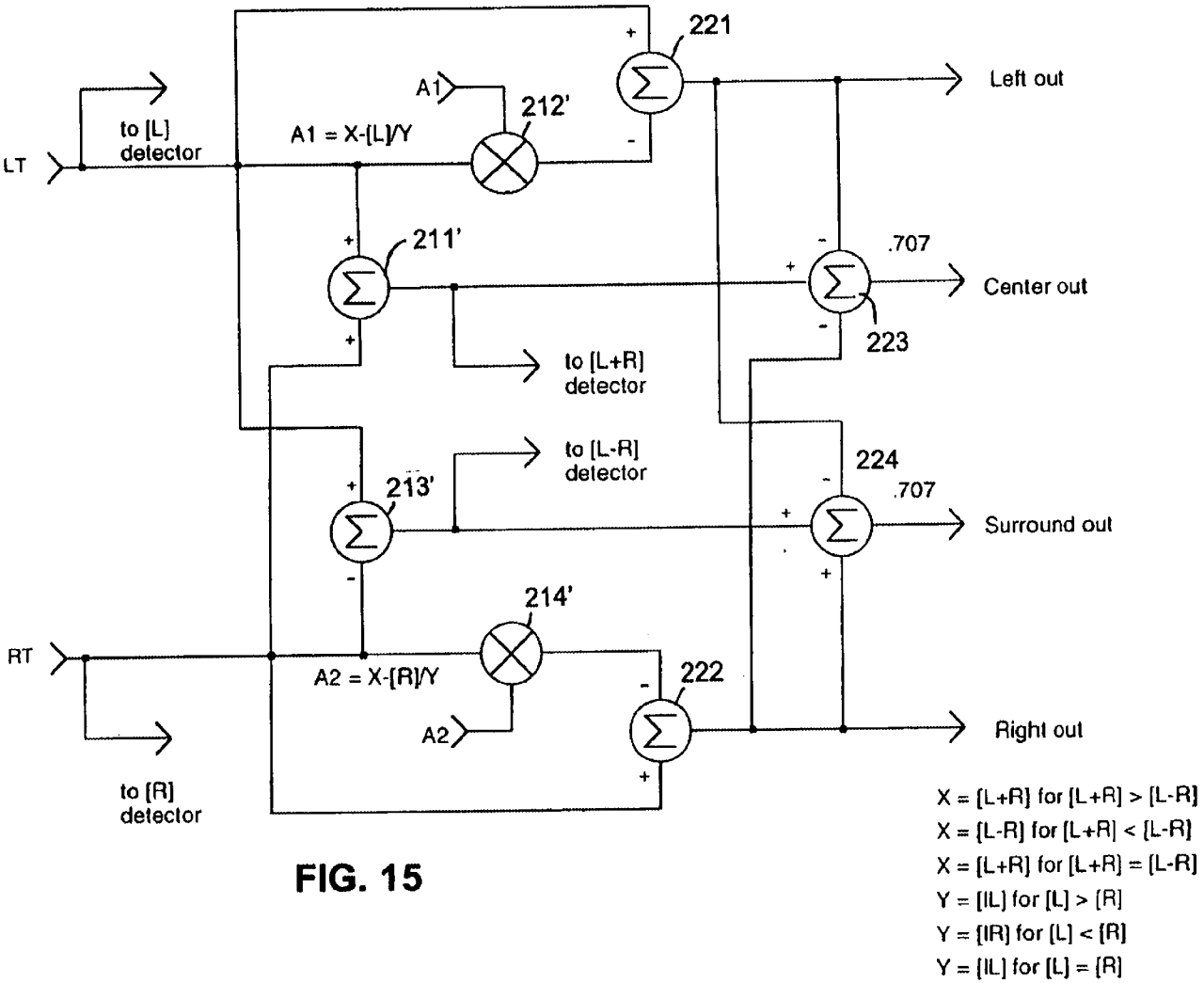
FIG. 15 is a block diagram illustrating the logical arrangement of another decoding system according to the invention that provides left, center and right output signal and a monophonic surround output signal.

Referring to FIG. 15, there is shown the logical arrangement of another decoding system according to the invention having advantageous properties in a system that provides left, center and right output signals and a monophonic surround output signal. Center signal combiner 211' cumulatively combines the left transmitted signal LT with the right transmitted signal RT to provide an output signal to one input of center combiner 223 for differential combining with the left and right output signals, respectively, from left signal combiner 221 and right signal combiner 222, respectively.

The left transmitted signal also energizes one input of left multiplier 212' energized by the A1 coefficient signal to provide a left product signal that is differentially combined with the left transmitted signal by left output combiner 221 to provide the left output signal.

Right input combiner 213' differentially combines the left transmitted signal LT and right transmitted signal RT to provide an output signal that is applied to one input of surround output combiner 224 for cumulative combination with the right output signal provided by right output combiner 222 and differential combination with the output of left output combiner 221 to provide the surround output signal.

The right transmitted signal also energizes one input of right multiplier 214' for multiplication by the A2 coefficient signal applied to the other input to provide a right product signal that is differentially combined with the right transmitted signal in right output combiner 222 to provide the right output signal.

The following table indicates the values of X and Y for the indicated conditions determined by the magnitude detectors that compare the magnitudes of L and R and the magnitudes of L+R and L−R.

$$X=[L+R] \text{ for } [L+R]>[L-R]$$

$$X=[L-R] \text{ for } [L+R]<[L-R]$$

$$X=[L+R] \text{ for } [L+R]=[L-R]$$

$$Y=[|L] \text{ for } [L]>[R]$$

$$Y=[|R] \text{ for } [L]<[R]$$

$$Y=[|L] \text{ for } [L]=[R]$$

Figure 16:
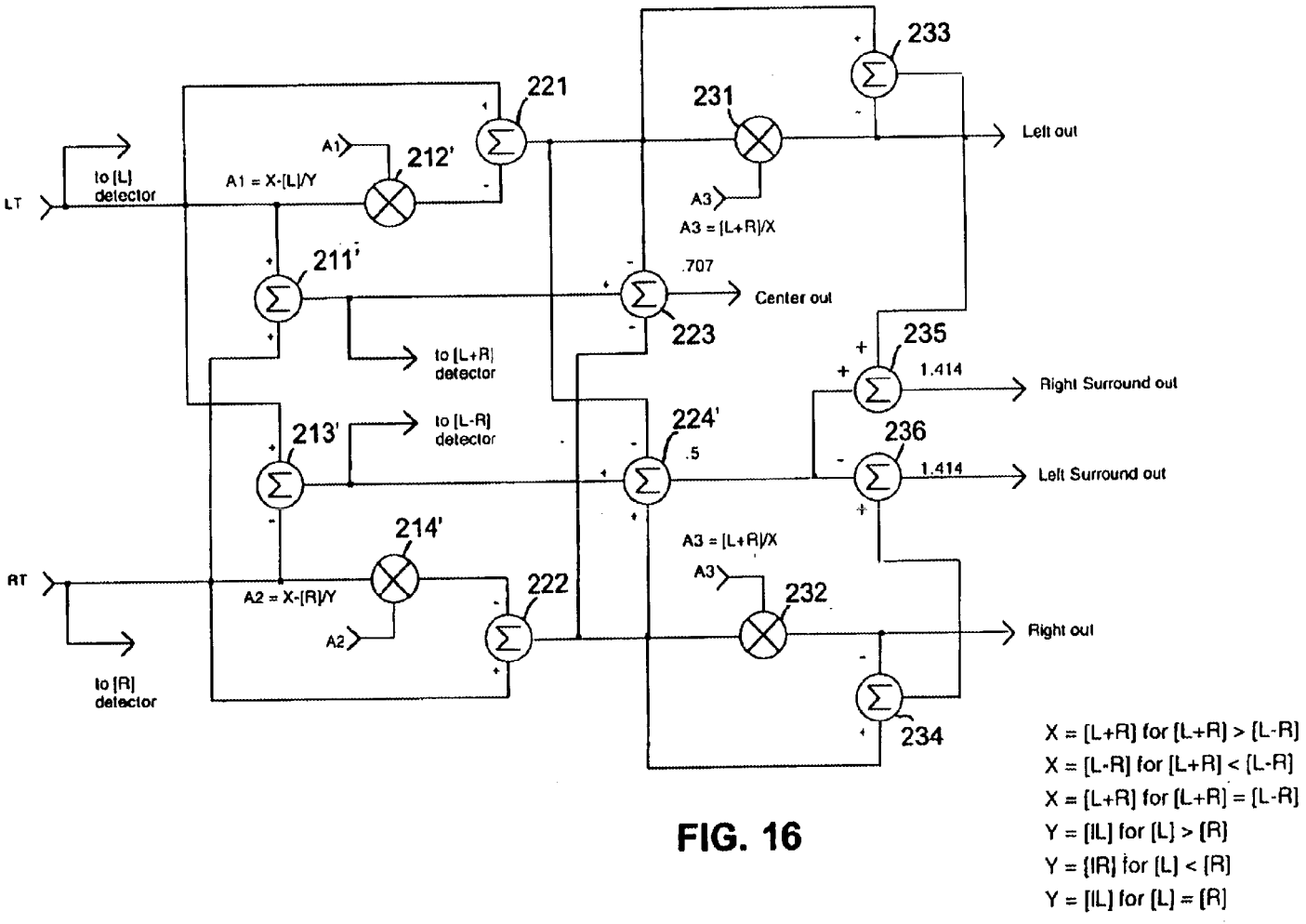
FIG. 16 is another embodiment of a decoder according to the invention that provides a stereo surround signal.

Referring to FIG. 16, there is shown another embodiment of a decoder according to the invention relatively free from complexity that provides a stereo surround signal. This embodiment is a modification of the embodiment of FIG. 16 and includes additional elements to provide the right and left surround output. The output of left output combiner 221 is delivered to one input of left output multiplier 231 whose other input receives the A3 coefficient signal to provide the left output signal that is differentially combined with the output of left output combiner 221 in left input surround combiner 233 to provide a product signal that is cumulatively combined with the output of surround output combiner 224' by right surround output combiner 235 to provide the right surround output signal.

The output of right output combiner 232 energizes one input of right output multiplier 232 energized at its other input by the A3 coefficient signal to provide the right output signal that is differentially combined with the output of right output combiner 222 in right input surround combiner 234 to provide a signal that is differentially combined with the output of right surround output combiner 224' to provide the left surround output.

Figure 17:
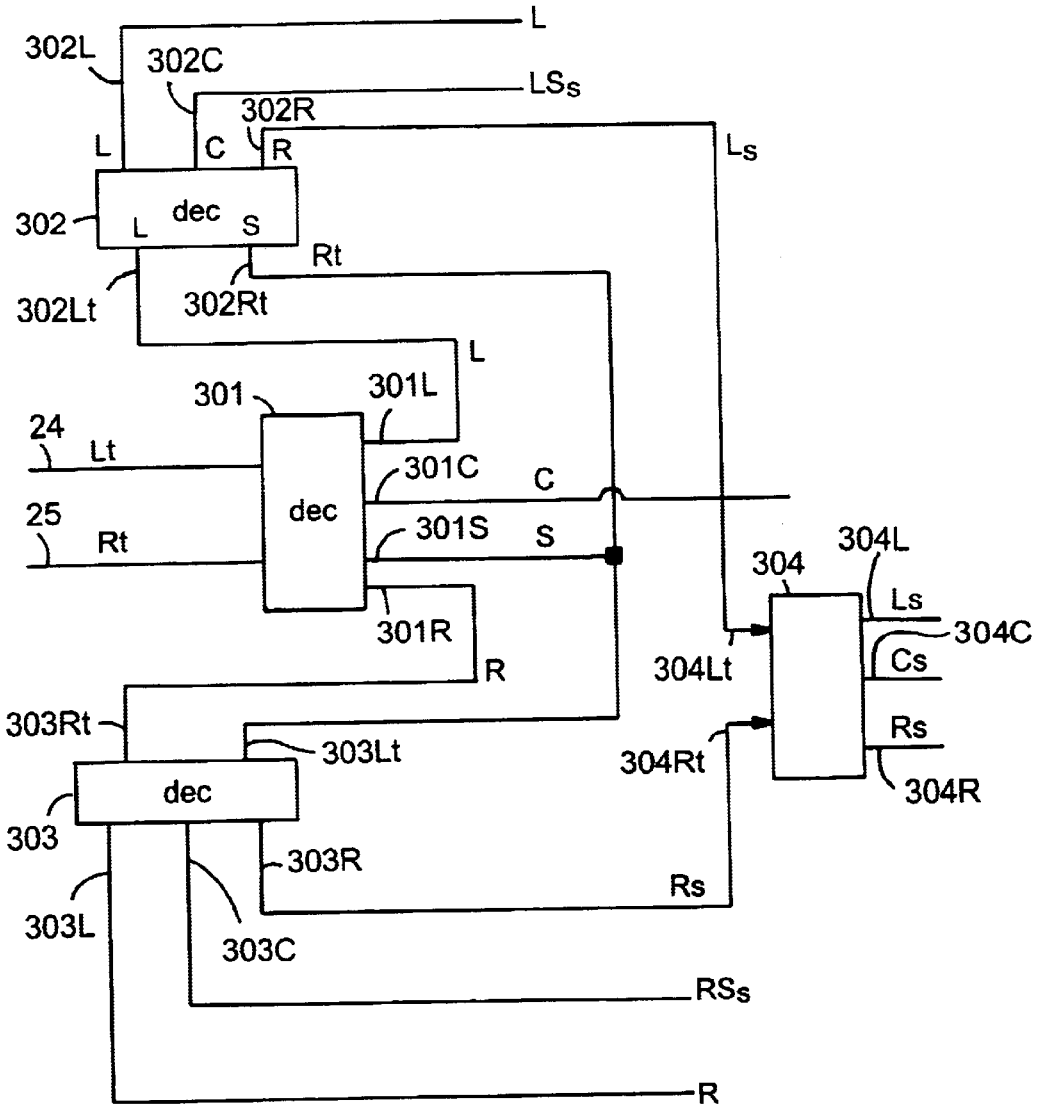
FIG. 17 is a block diagram illustrating the logical arrangement of a decoding system according to the invention using a plurality of stereo decoders to provide left, right, center, left surround, center surround, right surround, left side surround and right side surround signals.

Referring to FIG. 17, there is shown a block diagram illustrating the logical arrangement of a multiple axis decoding system that uses a number of stereo decoders, each of which may be a conventional stereo decoder or a decoder described above capable of responding to a left transmitted signal Lt and a right transmitted signal Rt typically having a L left signal output, a C center signal output, a R right signal output with the first also having at least an S surround signal output to provide a left output signal, a right output signal, a center output signal, a left surround output signal, a center surround output signal, a right surround output signal, a left side surround output output and a right side surround output signal.

Input decoder 301 receives the left transmitted signal Lt on line 24 and the right transmitted signal Rt on line 25 and provides on its L output 301L a signal that is applied to the Lt input 302Lt of left decoder 302 and on its right output 301R a signal delivered to the Rt input 303Rt of right decoder 303.

Input decoder 301 provides on the surround S output 301S a signal that is delivered to the Rt input 302Rt of left decoder 302 and to the Lt input 303Lt of right decoder 303 and provides the center output signal on its C output 301C.

Left decoder 302 provides the left output signal on its L output 302L, the left side surround output signal $LS_S$ on its C output 302C and a signal on its R output 302R that is delivered to the Lt input 304Lt of surround output decoder 304 that provides the left surround output signal Ls on the L output 304L.

Right decoder 303 provides the right output signal on the L output 303L, the right side surround output signal RS, on the C output 303C and a signal on the R output 303R delivered to the Rt input 304Rt of surround decoder 304 that provides the right surround output signal Rs on its R output 304R and the center surround output signal Cs on its C output 304C.

Figure 18:
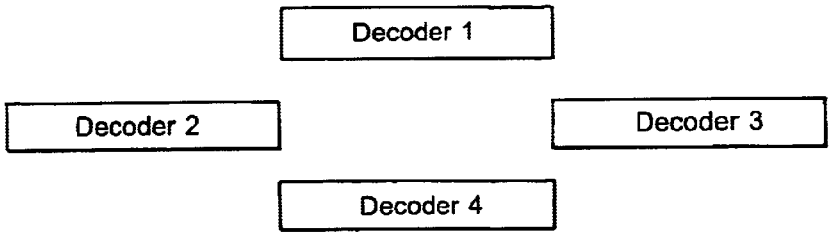
FIG. 18 is a table illustrating the signals at the different terminals of the stereo decoders of FIG. 17.

Referring to FIG. 18, there is shown a table helpful in understanding the signals from and to the four decoders. It is convenient to identify the input decoder 301 as decoder 1, the left decoder 302 as decoder 2, the right decoder 303 as decoder 3 and the surround decoder 304 as decoder 4. Designating the two inputs of each decoder as Lt in and Rt in and the outputs of each decoder as L out, R out, C out and S out, the table shows the signals at each of these terminals that results in furnishing left, center and right output signals L, C and R, respectively, normally reproduced by left front, center front and right front speakers, left and right side surround output signals $L_S$ and $R_S$ signals, respectively, normally reproduced by left and right side speakers, respectively, and left surround, center surround and right surround output signals, Ls, Cs and Rs, respectively, normally reproduced by left, center and right rear speakers, respectively.

Other embodiments are within the claims.

What is claimed is:

1. Surround sound encoding apparatus comprising, a source of at least left, right, center, left surround, right surround and low frequency effect (LFE) signals, a left combiner having a left input for receiving said left signal, a left surround input for receiving said left surround signal, a left LFE input for receiving substantially 0.707 of said LFE signal, and a left center input for receiving substantially 0.707 of said center signal and an output for providing a left transmitted signal representative of the cumulative combination of the signals on said left, left surround, left LFE and left center inputs, and a right combiner having a right input for receiving said right signal, a right surround input for receiving said right surround signal, a right LFE input for receiving substantially 0.707 of said LFE signal, and a right center input for receiving substantially 0.707 of said center signal and an output for providing a right transmitted signal representative of the cumulative combination of the signals on said right, right LFE and right center inputs differentially combined with the signal on said right surround input.

2. Apparatus in accordance with claim 1 and further comprising a decoder having a left combined input and a right combined input, at least a left signal output, right signal output, center signal output, left surround output, right surround output and a bass output, a plurality of algebraic signal combiners intercoupling said left combined input and said right combined input and said left, right, center, left surround, right surround and bass outputs constructed and arranged to provide a left signal on said left output representative of a left channel signal component in the signal on said left combined signal input, a right signal on said right output terminal representative of a right channel component in a signal on said right combined input, a center signal on said center output representative of center signal components of signals on said left combined signal input and said right combined signal input, a left surround signal on said left surround output representative of a left surround component in a signal on said left combined input, a right surround signal on said right surround output representative of a right surround component in a signal on said right combined input, and a bass signal on said bass output terminal representative of bass spectral components in signals on said left combined input and said right combined input.

3. Apparatus in accordance with claim 2 and further comprising a center surround output coupled to said left combined input and said right combined input by a plurality of said algebraic combiners constructed and arranged to provide a center surround signal on said center surround output representative of a center surround signal component in the signals on said left combined input and said right combined input.

4. Apparatus in accordance with claim 2 wherein said decoder includes, a left normalizing multiplier having a first input coupled to said left combined input and a second input for receiving a signal related to the ratio of the magnitude of the signal on said right combined input to a common signal for providing a left normalized product signal related to the product of the signals on said first and second inputs, a right normalizing multiplier having a first input coupled to said right combined input and a second input for receiving a signal related to the ratio of the magnitude of the signal on said left combined input to said common signal for providing a right normalizing product signal at its output related to the product of the signals on the latter first and second inputs, a left normalizing combiner having a first input coupled to the output of said left normalizing multiplier and a second input coupled to the output of said right normalizing multiplier constructed and arranged to cumulatively combine the signals on said left normalizing multiplier output and said right normalizing multiplier output to provide a first normalized signal at its output, a right signal combiner having a first input coupled to the output of said left normalizing multiplier and a second input coupled to the output of said right normalizing multiplier for differentially combining the signals on its first and second inputs to provide at its output a second normalizing signal.

5. Apparatus in accordance with claim 4 wherein said decoder further includes, apparatus for providing a difference signal output for sum signal dominance and a sum signal output for difference signal dominance comprising, an L+R input coupled to the output of said left normalizing signal combiner, a first L+R multiplier having said L+R input as a first input and a second input for receiving a signal related to the difference between a second common signal and the ratio of the signal on said L+R input to said second common signal to provide an intermediate L+R signal at its output representative of the product of the signals on its first and second inputs, a second L+R multiplier having a first input coupled to the output of said first L+R multiplier and a second input for receiving a signal related to the ratio of said second common signal to the difference between said second common signal and the signal on said L+R input to provide an L+R signal only when L−R is greater than L+R, a first L−R multiplier having a first input coupled to the output of said right normalizing signal combiner and a second input for receiving a signal related to the difference between said second common signal and the ratio of an L−R signal to said second common signal for providing a product signal at its output representative of the product of the signals on its first and second inputs, and a second L−R multiplier having a first input coupled to the output of said first L−R multiplier and a second input for receiving a signal related to the ratio of said second common signal to the difference between said second common signal and said L−R signal to provide as an output an L−R signal only if said L+R is greater than said L−R signal.

6. Apparatus in accordance with claim 2 wherein said decoder further includes, a left operational amplifier having an inverting input for receiving a signal related to the magnitude of the signal on said left combined input and a noninverting input for receiving a signal related to said first common signal for providing at its output zero signal when the magnitude of R is greater than the magnitude of L, and a right operational amplifier having an inverting input for receiving a signal representative of the magnitude of the signal on said right combined input and a noninverting input for receiving a signal related to said first common signal for providing at its output zero signal when the magnitude of L is greater than the magnitude of R.

7. Apparatus in accordance with claim 6 wherein said decoder further includes logical apparatus responsive to relative magnitudes of L and R and relative magnitudes of L+R and L−R for selectively providing output signals comprising, an L+R input coupled to the output of said second L+R multiplier, a first adjacent channel multiplier having a first input coupled to said L+R input and a second input coupled to the output of said left operational amplifier for providing at its output the product of the signals on its first input and its second input, a first adjacent channel signal combiner having a first input coupled to the output of said first adjacent channel multiplier and a second input coupled to said L+R input for differentially combining the signals on its first and second inputs to provide an output only when the magnitude of L is greater than the magnitude of R and the magnitude of L−R is greater than the magnitude of L+R, a second adjacent channel signal multiplier having a first input coupled to said L+R input and a second input coupled to the output of said first operational amplifier, a second adjacent channel signal combiner having a first input coupled to the output of said second adjacent channel multiplier and a second input coupled to said L−R input for differentially combining the signals on its first and second inputs to provide on its output a signal only if the magnitude of R is greater than the magnitude of L and the magnitude of L−R is greater than the magnitude of L+R, a L−R input coupled to the output of said second L−R multiplier, a third adjacent channel multiplier having a first input coupled to said L−R input and a second input coupled to the output of said right operational amplifier for providing at its output a product signal related to the product of the signals on its first and second inputs, a third adjacent channel combiner having a first input coupled to the output of said third adjacent channel multiplier and a second input coupled to said L−R input for providing an output only if the magnitude of L is greater than the magnitude of R and the magnitude of L+R is greater than the magnitude of L−R, a fourth adjacent channel multiplier having a first input coupled to said L−R input and a second input coupled to the output of said left comparator for providing on its output a product signal representative of the product of the signals on its first and second inputs, and a fourth adjacent channel combiner having a first input coupled to the output of said fourth adjacent channel multiplier and a second input coupled to said L−R input for differentially combining the signals on its first and second inputs to provide an output only if the magnitude of R is greater than the magnitude of L and the magnitude of L+R is greater than the magnitude of L−R.

8. Apparatus in accordance with claim 7 wherein said decoder further includes apparatus for removing the adjacent channel signal from the sum and difference signals including, an L+R removal combiner having a first input coupled to the output of said fourth adjacent channel combiner, a second input coupled to the output of said third adjacent channel combiner, a third input coupled to the output of said second adjacent channel combiner, a fourth input coupled to the output of said first adjacent channel combiner and a fifth input arranged to receive a signal related to the sum of L times the ratio of the magnitude of R to said first common signal with the product of R times the ratio of the magnitude of L to said first common signal constructed and arranged to provide L+R at its output, and a L−R combiner having a first input coupled to the output of said fourth adjacent channel combiner, a second input coupled to the output of said third adjacent channel combiner, a third input coupled to the output of said second adjacent channel combiner, a fourth input coupled to the output of said first adjacent channel combiner, and a fifth input for receiving a signal related to the difference between L times the ratio of the magnitude of R to said first common signal and R times the ratio of the magnitude of L to said first common signal constructed and arranged to provide at its output L−R.

9. Apparatus in accordance with claim 8 wherein said decoder further includes, apparatus for normalizing the matrix for quadrature encoded signals comprising, a center multiplier having a first input coupled to the output of said L+R combiner and a second input arranged to receive a signal related to the ratio of said second common signal to the sum of the magnitude of L+R added to the magnitude of L−R to provide a product signal on its output representative of the signals on its first and second inputs, a first center combiner having a first input coupled to the output of said first center multiplier and a second input coupled to the first input of said center multiplier for differentially combining the signals on its first and second inputs to provide as an output a center complement signal, a second center signal combiner having a first input coupled to the output of said first center combiner and a second input coupled to the second input of said first center combiner for differentially combining the signals on its first and second inputs to provide a center signal, a surround multiplier having a first input coupled to the output of said L−R signal combiner and a second input for receiving a signal representative of the ratio of said second common signal to the magnitude of L+R added to the magnitude of L−R to provide a product signal at its output representative of the signals on its first and second inputs, a first surround combiner having a first input coupled to the output of said surround multiplier and a second input coupled to the first input of the surround multiplier for differentially combining the signals on its first and second inputs to provide a surround complement signal on its output, and a second surround combiner having a first input coupled to the output of said first surround combiner and a second input coupled to the second input of said first surround combiner for differentially combining the signals on the its first and second inputs to provide as an output signal on its output a surround signal.

10. Surround sound decoding apparatus comprising, a left combined input and a right combined input, at least a left output, right output, center output, left surround output, right surround output and a bass output, a plurality of algebraic signal combiners intercoupling said left combined input and said right combined input and said left, right, center, left surround, right surround and bass outputs constructed and arranged to provide a left signal on said left output representative of a left channel signal component in the signal on said left combined signal input, a right signal on said right output representative of a right channel component in a signal on said right combined input, a center signal on said center output representative of center signal components of signals on said left combined signal input and said right combined signal input, a left surround signal on said left surround output representative of a left surround component in a signal on said left combined input, a right surround signal on said right surround output representative of a right surround component in a signal on said right combined input, and a bass signal on said bass output representative of bass spectral components in signals on said left combined input and said right combined input, and further comprising a center surround output coupled to said left combined input and said right combined input by a plurality of said algebraic combiners constructed and arranged to provide a center surround signal on said center surround output representative of a center surround signal component in the signals on said left combined input and said right combined input.

11. Surround sound decoding apparatus comprising, a left combined input and a right combined input, at least a left output, right output, center output, left surround output, right surround output and a bass output, a plurality of algebraic signal combiners intercoupling said left combined input and said right combined input and said left, right, center, left surround, right surround and bass outputs constructed and arranged to provide a left signal on said left output representative of a left channel signal component in the signal on said left combined signal input, a right signal on said right output representative of a right channel component in a signal on said right combined input, a center signal on said center output representative of center signal components of signals on said left combined signal input and said right combined signal input, a left surround signal on said left surround output representative of a left surround component in a signal on said left combined input, a right surround signal on said right surround output representative of a right surround component in a signal on said right combined input, and a bass signal on said bass output representative of bass spectral components in signals on said left combined input and said right combined input, wherein said apparatus includes, a left normalizing multiplier having a first input coupled to said left combined input and a second input for receiving a signal related to the ratio of the magnitude of the signal on said right combined input to a common signal for providing a left normalized product signal related to the product of the signals on said first and second inputs, a right normalizing multiplier having a first input coupled to said right combined input and a second input for receiving a signal related to the ratio of the magnitude of the signal on said left combined input to said common signal for providing a right normalizing product signal at its output related to the product of the signals on the latter first and second inputs, a left normalizing combiner having a first input coupled to the output of said left normalizing multiplier and a second input coupled to the output of said right normalizing multiplier constructed and arranged to cumulatively combine the signals on said left normalizing multiplier output and said right normalizing multiplier output to provide a first normalized signal at its output, a right signal combiner having a first input coupled to the output of said left normalizing multiplier and a second input coupled to the output of said right normalizing multiplier for differentially combining the signals on its first and second inputs to provide at its output a second normalizing signal.

12. Apparatus in accordance with claim 11 wherein said apparatus further includes, apparatus for providing a difference signal output for sum signal dominance and a sum signal output for difference signal dominance comprising, an L+R input coupled to the output of said left normalizing signal combiner, a first L+R multiplier having said L+R input as a first input and a second input for receiving a signal related to the difference between a second common signal and the ratio of the signal on said L+R input to said second common signal to provide an intermediate L+R signal at its output representative of the product of the signals on its first and second inputs, a second L+R multiplier having a first input coupled to the output of said first L+R multiplier and a second input for receiving a signal related to the ratio of said second common signal to the difference between said second common signal and the signal on said L+R input to provide an L+R signal only when L−R is greater than L+R, a first L−R multiplier having a first input coupled to the output of said right normalizing signal combiner and a second input for receiving a signal related to the difference between said second common signal and the ratio of an L−R signal to said second common signal for providing a product signal at its output representative of the product of the signals on its first and second inputs, and a second L−R multiplier having a first input coupled to the output of said first L−R multiplier and a second input for receiving a signal related to the ratio of said second common signal to the difference between said second common signal and said L−R signal to provide as an output an L−R signal only if said L+R is greater than said L−R signal.

13. Apparatus in accordance with claim 12 wherein said apparatus further includes, a left operational amplifier having an inverting input for receiving a signal related to the magnitude of the signal on said left combined input and a noninverting input for receiving a signal related to said first common signal for providing at its output zero signal when the magnitude of R is greater than the magnitude of L, and a right operational amplifier having an inverting input for receiving a signal representative of the magnitude of the signal on said right combined input and a noninverting input for receiving a signal related to said first common signal for providing at its output zero signal when the magnitude of L is greater than the magnitude of R.

14. Apparatus in accordance with claim 13 wherein said apparatus further includes logical apparatus responsive to relative magnitudes of L and R and relative magnitudes of L+R and L−R for selectively providing output signals comprising, an L+R input coupled to the output of said second L+R multiplier, a first adjacent channel multiplier having a first input coupled to said L+R input and a second input coupled to the output of said left operational amplifier for providing at its output the product of the signals on its first input and its second input, a first adjacent channel signal combiner having a first input coupled to the output of said first adjacent channel multiplier and a second input coupled to said L+R input for differentially combining the signals on its first and second inputs to provide an output only when the magnitude of L is greater than the magnitude of R and the magnitude of L−R is greater than the magnitude of L+R, a second adjacent channel signal multiplier having a first input coupled to said L+R input and a second input coupled to the output of said first operational amplifier, a second adjacent channel signal combiner having a first input coupled to the output of said second adjacent channel multiplier and a second input coupled to said L−R input for differentially combining the signals on its first and second inputs to provide on its output a signal only if the magnitude of R is greater than the magnitude of L and the magnitude of L−R is greater than the magnitude of L+R, a L−R input coupled to the output of said second L−R multiplier, a third adjacent channel multiplier having a first input coupled to said L−R input and a second input coupled to the output of said right operational amplifier for providing at its output a product signal related to the product of the signals on its first and second inputs, a third adjacent channel combiner having a first input coupled to the output of said third adjacent channel multiplier and a second input coupled to said L−R input for providing an output only if the magnitude of L is greater than the magnitude of R and the magnitude of L+R is greater than the magnitude of L−R, a fourth adjacent channel multiplier having a first input coupled to said L−R input and a second input coupled to the output of said left comparator for providing on its output a product signal representative of the product of the signals on its first and second inputs, and a fourth adjacent channel combiner having a first input coupled to the output of said fourth adjacent channel multiplier and a second input coupled to said L−R input for differentially combining the signals on its first and second inputs to provide an output only if the magnitude of R is greater than the magnitude of L and the magnitude of L+R is greater than the magnitude of L−R.

15. Apparatus in accordance with claim 14 wherein said apparatus further includes apparatus for removing the adjacent channel signal from the sum and difference signals including, an L+R removal combiner having a first input coupled to the output of said fourth adjacent channel combiner, a second input coupled to the output of said third adjacent channel combiner, a third input coupled to the output of said second adjacent channel combiner, a fourth input coupled to the output of said first adjacent channel combiner and a fifth input arranged to receive a signal related to the sum of L times the ratio of the magnitude of R to said first common signal with the product of R times the ratio of the magnitude of L to said first common signal constructed and arranged to provide L+R at its output, and a L−R combiner having a first input coupled to the output of said fourth adjacent channel combiner, a second input coupled to the output of said third adjacent channel combiner, a third input coupled to the output of said second adjacent channel combiner, a fourth input coupled to the output of said first adjacent channel combiner, and a fifth input for receiving a signal related to the difference between L times the ratio of the magnitudes of R to said first common signal and R times the ratio of the magnitude of L to said first common signal constructed and arranged to provide at its output L−R.

16. Apparatus in accordance with claim 15 wherein said apparatus further includes, apparatus for normalizing the matrix for quadrature encoded signals comprising, a center multiplier having a first input coupled to the output of said L+R combiner and a second input arranged to receive a signal related to the ratio of said second common signal to the sum of the magnitude of L+R added to the magnitude of L−R to provide a product signal on its output representative of the signals on its first and second inputs, a first center combiner having a first input coupled to the output of said first center multiplier and a second input coupled to the first input of said center multiplier for differentially combining the signals on its first and second inputs to provide as an output a center complement signal, a second center signal combiner having a first input coupled to the output of said first center combiner and a second input coupled to the second input of said first center combiner for differentially combining the signals on its first and second inputs to provide a center signal, a surround multiplier having a first input coupled to the output of said L−R signal combiner and a second input for receiving a signal representative of the ratio of said second common signal to the magnitude of L+R added to the magnitude of L−R to provide a product signal at its output representative of the signals on its first and second inputs, a first surround combiner having a first input coupled to the output of said surround multiplier and a second input coupled to the first input of the surround multiplier for differentially combining the signals on its first and second inputs to provide a surround complement signal on its output, and a second surround combiner having a first input coupled to the output of said first surround combiner and a second input coupled to the second input of said first surround combiner for differentially combining the signals on its first and second inputs to provide as an output signal on its output a surround signal.

17. Surround sound decoding apparatus comprising, a left combined input and a right combined input, at least a left output, right output, center output, left surround output, right surround output and a bass output, a plurality of algebraic signal combiners intercoupling said left combined input and said right combined input and said left, right, center, left surround, right surround and bass outputs constructed and arranged to provide a left signal on said left output representative of a left channel signal component in the signal on said left combined signal input, a right signal on said right output representative of a right channel component in a signal on said right combined input, a center signal on said center output representative of center signal components of signals on said left combined signal input and said right combined signal input, a left surround signal on said left surround output representative of a left surround component in a signal on said left combined input, a right surround signal on said right surround output representative of a right surround component in a signal on said right combined input, and a bass signal on said bass output representative of bass spectral components in signals on said left combined input and said right combined input, wherein said algebraic signal combiners include a left input multiplier for multiplying the signal on said left combined input with an A9 coefficient signal, and a right input multiplier for multiplying the signal on said right combined input with an A10 coefficient signal to provide a right input product signal.

18. Apparatus in accordance with claim 17 where said algebraic signal combiners further include a left signal combiner for cumulatively combining the signals on said left combined input and said right combined input and differentially combining said left input product signal and said right input product signal to provide a left combined signal, and a right input signal combiner for differentially combining the signals on said left combined input and said right combined input and differentially combining said left input product signal and said right input product signal to provide a right combined signal.

19. Surround sound decoding apparatus comprising, a left combined input and a right combined input, at least a left output, right output, center output, left surround output, right surround output and a bass output, a plurality of algebraic signal combiners intercoupling said left combined input and said right combined input and said left, right, center, left surround, right surround and bass outputs constructed and arranged to provide a left signal on said left output representative of a left channel signal component in the signal on said left combined signal input, a right signal on said right output representative of a right channel component in a signal on said right combined input, a center signal on said center output representative of center signal components of signals on said left combined signal input and said right combined signal input, a left surround signal on said left surround output representative of a left surround component in a signal on said left combined input, a right surround signal on said right surround output representative of a right surround component in a signal on said right combined input, and a bass signal on said bass output representative of bass spectral components in signals on said left combined input and said right combined input, wherein said plurality of algebraic signal combiners include a left plurality of input multipliers each coupled to said left combined input by a respective bandpass filter, said bandpass filters selectively transmitting contiguous bands of spectral components of the signal on said left combined input to a respective multiplier for multiplication by a respective coefficient signal to provide a respective left input product signal, said bandpass filters selectively transmitting contiguous bands of spectral components of the signal on said right combined input to a respective multiplier for multiplication by a respective coefficient signal to provide a respective right input product signal, a left signal combiner for cumulatively combining the left input product signals to provide a left combined signal, and a right signal combiner for cumulatively combining the right input product signals to provide a right combined signal.

20. Surround sound decoding apparatus comprising, a left combined input and a right combined input, at least a left output, right output, center output, left surround output, right surround output and a bass output, a plurality of algebraic signal combiners intercoupling said left combined input and said right combined input and said left, right, center, left surround, right surround and bass outputs constructed and arranged to provide a left signal on said left output representative of a left channel signal component in the signal on said left combined signal input, a right signal on said right output representative of a right channel component in a signal on said right combined input, a center signal on said center output representative of center signal components of signals on said left combined signal input and said right combined signal input, a left surround signal on said left surround output representative of a left surround component in a signal on said left combined input, a right surround signal on said right surround output representative of a right surround component in a signal on said right combined input, and a bass signal on said bass output representative of bass spectral components in signals on said left combined input and said right combined input, wherein said plurality of algebraic signal combiners include a left input bass signal combiner for cumulatively combining the signals on said left combined input and said right combined input to provide a left cumulatively combined signal, a right input bass signal combiner for cumulatively combining the signals on said left combined input and said right combined input to provide a differentially combined bass signal, a left bass multiplier for multiplying said cumulatively combined bass signal with a coefficient signal to provide a left bass product signal, right bass multiplying circuitry for multiplying said differentially combined bass signal with at least one coefficient signal to provide a right bass product signal, an output bass signal combiner for cumulatively combining said left bass product signal with said right bass product signal to provide a cumulatively combined bass product signal, and an output multiplier for multiplying said cumulatively combined bass product signal with an output coefficient signal to provide said bass signal.

21. Surround sound decoding apparatus comprising, a left combined input and a right combined input, at least a left signal output, right signal output, center signal output, and surround output, a plurality of algebraic signal combiners intercoupling said left combined input and said right combined input and said left signal output, right signal output, center signal output and surround signal output constructed and arranged to provide a left signal on said left output representative of a left channel signal component in the signal on said left combined signal input, a right signal on said right output representative of a right channel signal component in a signal on said right combined signal input, a center signal on said center output representative of center signal components of signals on said left combined signal input and said right combined signal input, and a surround signal on said surround output representative of surround signal components on said left combined signal input and said right combined signal input, said algebraic signal combiners including at least a left multiplier for multiplying the signal on said left combined signal input with a first coefficient signal, and a right multiplier for multiplying a signal on said right combined input with a second coefficient signal, said first and second coefficient signals being related to which of a left signal component on said left combined signal input and a right signal component on said right combined signal input is larger and which of the magnitudes of the sum of said left and right components and the magnitude of the difference therebetween is the larger.

22. Surround sound decoding apparatus in accordance with claim 21 wherein said algebraic combiners include a left input signal combiner for cumulatively combining the signals on said left combined input and said right combined input, a right input signal combiner for differentially combining the signals on said left combined input and said right combined input, a left output signal combiner for differentially combining the output of said left multiplier with the signal on said left combined input, a right output signal combiner for differentially combining the output of said right multiplier with the signal on said right combined input, a center output signal combiner for differentially combining the output of said left signal combiner with the output of said left output signal combiner and the output of said right signal combiner, and a surround combiner for cumulatively combining the outputs of said right input combiner and said right output combiner and differentially combining the output of said right input signal combiner with the output of said left output signal combiner.

23. Apparatus in accordance with claim 22 wherein said algebraic combiners further comprise, a left output multiplier for multiplying the output of said left output signal combiner with a said coefficient signal, a right multiplier for multiplying the output of said right output signal combiner with a said coefficient signal, a left input surround signal combiner for differentially combining the output from said left output signal combiner with the output of said left output multiplier, a right input surround combiner for differentially combining the signal at the output of said output right signal combiner with the output of said right output multiplier, a right output surround signal combiner for cumulatively combining the output of said surround combiner with the output of said left input surround combiner, and a left output surround combiner for combining the output of said right input surround combiner with the output of said surround combiner.

24. Surround sound decoding apparatus comprising, an input decoder having a Lt input for receiving a left transmitted signal and a Rt input for receiving a right transmitted signal, a L output for normally providing a left output signal, a C output for normally providing a center output signal, a S output for normally providing a surround output signal and a R output for normally providing a right output signal, a left decoder having a Lt input for normally receiving a left transmitted signal coupled to the L output of said input decoder, a Rt input for normally receiving a right transmitted signal coupled to the S output of said input decoder, a L output for providing a left output signal, a C output for normally providing a center output signal and providing a left side surround output signal and a R output, a right decoder having an Lt input for normally receiving a left transmitted signal coupled to the S output of said input decoder and an Rt input for normally receiving a right transmitted signal coupled to the R output of said input decoder, a L output for normally providing a left output signal for providing a right output signal, a C output for normally providing a center output signal for providing a right side surround output signal and an R output for normally providing a right output signal, and a surround decoder having a Lt input for normally receiving a left transmitted signal coupled to the R output of said left decoder, an Rt input for normally receiving a right transmitted signal coupled to the R output of said right decoder, an L output for normally providing a left output signal for providing a left surround output signal, a C output for normally providing a center output signal for providing a center surround output signal, and a R output for normally providing a right output signal for providing a right surround output signal.

25. Surround sound decoding apparatus comprising, a first combined input and a second combined input, a plurality of algebraic signal combiners including a first input bass signal combiner for cumulatively combining the signals on said first combined input and said second combined input to provide a first cumulatively combined signal, a second input bass signal combiner for cumulatively combining the signals on said first combined input and said second combined input to provide a differentially combined bass signal, a first bass multiplier for multiplying said first cumulatively combined signal with a coefficient signal to provide a first bass product signal, a second bass multiplier for multiplying said differentially combined bass signal with at least one coefficient signal to provide a second bass product signal, an output bass signal combiner for cumulatively combining said first bass product signal with said second bass product signal to provide a cumulatively combined bass product signal, and an output multiplier for multiplying said cumulatively combined bass product signal with an output coefficient signal to provide an output bass signal.

26. Surround sound decoding apparatus comprising, a first decoder having a first input for receiving a first transmitted signal and a second input for receiving a second transmitted signal, a first output for normally providing a first output signal, a second output for normally providing a second output signal and a third output for normally providing a third output signal, and a second decoder having a first input for normally receiving a first transmitted signal coupled to the first output of said first decoder, a second input for normally receiving a second transmitted signal coupled to the second output of said first decoder, a first output for providing a second first output signal, a second output for providing a second second output signal and a third output for providing a second third output signal.

27. Surround sound decoding apparatus in accordance with claim 26 wherein said first decoder has a fourth output for normally providing a fourth output signal and further comprising, a third decoder having a first input for normally receiving a first transmitted signal coupled to the fourth output of said first decoder and a second input for normally receiving a second transmitted signal coupled to the second output of said first decoder, a first output for normally providing a first output signal for providing a third first output signal, a second output for normally providing a second output signal for providing a third second output signal and a third output for normally providing a third output signal for providing a third third output signal.

28. Surround sound decoding apparatus in accordance with claim 27 and further comprising, a fourth decoder having a first input for normally receiving a first transmitted signal coupled to the second output of said second decoder, a second input for normally receiving a second transmitted signal coupled to the second output of said third decoder, a first output for normally providing a first output signal for providing a fourth first output signal, a third output for normally providing a third output signal for providing a fourth third output signal, and a second output for normally providing a second output signal for providing a fourth second output signal.

* * * * *